US006891157B2

(12) United States Patent
Bateman et al.

(10) Patent No.: US 6,891,157 B2
(45) Date of Patent: May 10, 2005

(54) MASS SPECTROMETER

(75) Inventors: Robert Harold Bateman, Knutsford (GB); Andrew Entwistle, Stretford (GB)

(73) Assignee: Micromass UK Limited, Manchester (GB)

( * ) Notice: Subject to any disclaimer, the term of this patent is extended or adjusted under 35 U.S.C. 154(b) by 0 days.

(21) Appl. No.: 10/449,030

(22) Filed: Jun. 2, 2003

(65) Prior Publication Data

US 2004/0026614 A1 Feb. 12, 2004

Related U.S. Application Data

(60) Provisional application No. 60/422,153, filed on Oct. 30, 2002.

(30) Foreign Application Priority Data

May 31, 2002 (GB) ..... 0212634
Jul. 5, 2002 (GB) ..... 0215627

(51) Int. Cl.[7] ..... H01J 49/42
(52) U.S. Cl. ..... 250/292
(58) Field of Search ..... 250/292

(56) References Cited

U.S. PATENT DOCUMENTS 5,206,506 A * 4/1993 Kirchner ..... 250/281
5,811,820 A * 9/1998 Kirchner et al. ..... 250/281
5,825,026 A 10/1998 Baykut
5,939,718 A * 8/1999 Yamada et al. ..... 250/288

FOREIGN PATENT DOCUMENTS

EP 0237259 A2 * 9/1987 ..... 250/292
EP 1 271 608 A2 1/2003
GB 2341270 3/2000
GB 2 373 630 A 9/2002
WO WO 02/43105 5/2002

* cited by examiner

*Primary Examiner*—Jack I. Berman
(74) *Attorney, Agent, or Firm*—Diederiks & Whitelaw, PLC

(57) ABSTRACT

A mass spectrometer is disclosed comprising an AC or RF ion guide having a plurality of plate electrodes and an upper plate electrode and a lower plate electrode. One or more channels are formed within the plate electrodes so that an ion guiding region is formed within the ion guide. The channels and hence the ion guiding region may be curved.

91 Claims, 15 Drawing Sheets

MASS SPECTROMETER

CROSS-REFERENCE TO RELATED APPLICATIONS

This application claims the benefit of the filing of U.S. Provisional Patent Application Ser. No. 60/422,153 filed Oct. 30, 2002.

BACKGROUND OF THE INVENTION

1. Field of the Invention

The present invention relates to a mass spectrometer, a method of mass spectrometry and a method of manufacturing an ion guide for a mass spectrometer.

2. Discussion of the Prior Art

Multipole rod set RF ion guides are known and are used for transporting ions at relatively low pressures (e.g. $<10^{-4}$ mbar) where ion collisions with background gas molecules are unlikely and also for transporting ions at intermediate pressures (e.g. $10^{-4}$–10 mbar) where ion-molecule collisions may be expected to occur. Multipole rod set RF ion guides are used at intermediate pressures for a wide range of applications. For example, multipole rod set RF ion guides are used as collision cells where ion-molecule collisions are intended to induce ion fragmentation and as reaction cells where ion-molecule collisions are intended to result in ion-molecule reactions. Multipole rod set RF ion guides are also used as cooling devices where ion-molecule collisions lead to equilibration of the ion and gas molecule temperatures or kinetic energies. Known multipole rod set RF ion guides have a straight central axis with a single ion entrance and a single ion exit.

It is desired to provide a mass spectrometer having an improved RF ion guide.

SUMMARY OF THE INVENTION

According to an aspect of the present invention there is provided a mass spectrometer comprising an ion guide. The ion guide comprises a plurality of plate electrodes and has an entrance for receiving ions along a first axis and an exit from which ions emerge from the ion guide along a second axis. The second axis is at an angle θ to the first axis wherein θ>0°. An ion guiding region is provided between the entrance port and exit port of the ion guide. In the preferred embodiment the angle θ is preferably <10°, 10–20°, 20–30°, 30–40°, 40–50°, 50–60°, 60–70°, 70–80°, 80–90°, 90–100°, 100–110°, 110–120°, 120–130°, 130–140°, 140–150°, 150–160°, 160–170°, or 170–180°. Angles >180° are also contemplated wherein the ion guide comprises a spiral ion guiding region. An angle of 0° corresponds with the second axis being parallel with the first axis. An angle of 180° corresponds with an embodiment wherein a U-shaped ion guiding region was provided within the ion guide such that ions entering the ion guide are turned around by 180° before exiting the ion guide in the opposite direction to which the ions entered the ion guide.

From another aspect the present invention provides a mass spectrometer comprising an ion guide having a plurality of plate electrodes, an entrance for receiving ions along a first axis and an exit from which ions emerge along a second axis. The ion guide further comprises a curved ion guiding region between the entrance and exit. The curved ion guiding region preferably comprises a single continuous, preferably smoothly continuous, ion guiding region through which the ions are guided from the entrance to the exit. In the preferred embodiment the ion guiding region is substantially "S"-shaped and/or has a single point of inflexion. According to this particular embodiment the phrase "curved ion guiding region" should not be construed as a labyrinthine or maze-like ion guiding region or a labyrinthine or maze-like ion guiding region having one or more dead-ends. The first axis may be substantially parallel to and preferably laterally displaced from the second axis.

From another aspect the present invention provides a mass spectrometer comprising an ion guide having a plurality of plate electrodes, an entrance for receiving ions along a first axis, a curved ion guiding region and an exit from which ions emerge. In this ion guide the second axis is co-axial with the first axis.

An ion guide having a curved ion guiding region and co-axial first and second axes provides a longer ion guiding region without requiring the distance between the ion guide entrance and exit to be increased. This is particularly advantageous when the ion guide is used as a collision, fragmentation or reaction cell as the increased path length through the gas provides a higher probability of collisions, fragmentation or reactions occurring. In the preferred embodiment the ion guide further comprises a device such as a baffle, plate or electrode arranged at least partially outside of the ion guiding region to block neutral particles or photons passing directly from the entrance of the ion guide to the exit.

According to another aspect the present invention provides a mass spectrometer comprising a first ion guide having a plurality of plate electrodes, an entrance for receiving ions and an exit from which ions emerge. The mass spectrometer further comprises a second ion guide having a plurality of plate electrodes, an entrance for receiving ions and an exit from which ions emerge.

In the preferred embodiment the mass spectrometer further comprises a third ion guide having a plurality of plate electrodes, an entrance for receiving ions and an exit from which ions emerge. The mass spectrometer may also comprise a fourth ion guide having a plurality of plate electrodes, an entrance for receiving ions and an exit from which ions emerge. According to other embodiments five, six, seven, eight, nine, ten or more than ten ion guides may be provided.

In a mode of operation the first ion guide and the second ion guide may be maintained in use at different DC potentials so that ions exiting the first ion guide are urged into the second ion guide. The second and third ion guides may also be maintained in use at different DC potentials so that ions exiting the second ion guide are urged into the third ion guide. The third and fourth ion guides may also be maintained in use at different DC potentials so that ions exiting the third ion guide are urged into the fourth ion guide. Embodiments are also contemplated wherein ions are urged from the first to the second ion guides and/or from the second to the third ion guides and/or from the third to the fourth ion guides and/or out of the fourth ion guide.

In another or further mode of operation the second ion guide may be maintained at a different DC potential to the first ion guide so that ions are trapped in the first ion guide. The third ion guide may be maintained at a different DC potential to the second ion guide so that ions are trapped in the second ion guide. The fourth ion guide may be maintained at a different DC potential to the third ion guide so that ions are trapped in the third ion guide. Embodiments are also contemplated wherein, for example, ions are trapped in the first, second and third ion guides or in the second and third ion guides.

It will also be appreciated that the embodiments discussed above relating to urging ions out of an ion guide may be combined with the embodiments discussed above relating to trapping ions within an ion guide.

In a preferred embodiment either the first and/or second and/or third and/or fourth ion guides may comprise ion storage regions. In a first mode of operation these ion storage regions may receive ions through a single port and in a second mode of operation ions are enabled to emerge from the ion storage area through the same port.

From another aspect the present invention provides a mass spectrometer comprising an ion guide having a plurality of plate electrodes, two or more entrances for receiving ions and one or more exits from which ions emerge.

In the preferred embodiment the ion guide preferably comprises two entrances for receiving ions and one exit from which ions emerge. In another embodiment the ion guide comprises three entrances for receiving ions and one exit from which ions emerge. The plate electrodes may be formed to any shape such that ion beams can be received by the ion guide or exit the ion guide at any angle or from any direction.

Further embodiments are contemplated wherein 1, 2, 3, 4, 5, 6, 7, 8, 9, 10 or more than 10 ion entrances are provided and wherein 1, 2, 3, 4, 5, 6, 7, 8, 9, 10 or more than 10 ion exits are provided. For example, the ion guide may comprise three entrances and three exits.

Preferably, the mass spectrometer further comprises at least two of the same or different ion sources. The ion sources are preferably at least one of an Electrospray ("ESI") ion source, an Atmospheric Pressure Chemical Ionisation ("APCI") ion source, an Atmospheric Pressure Photo Ionisation ("APPI") ion source, a Matrix Assisted Laser Desorption Ionisation ("MALDI") ion source, a Laser Desorption Ionisation ("LDI") ion source, an Inductively Coupled Plasma ("ICP") ion source, an Electron Impact ("EI") ion source, a Chemical Ionisation ("CI") ion source, a Fast Atom Bombardment ("FAB") ion source or a Liquid Secondary Ions Mass Spectrometry ("LSIMS") ion source.

Embodiments are contemplated wherein, for example, two ion sources are provided. One ion source may be a continuous ion source such as an APCI or Electrospray ion source and the other ion source may be a pulsed ion source such as a MALDI ion source.

Embodiments are also contemplated wherein more than two ion sources are provided. For example, according to an embodiment at least 3, 4, 5, 6, 7, 8, 9 or 10 APCI, Electrospray or one of the other ion sources mentioned above may be provided. The preferred ion guide may allow ions from one or more selected ion sources to be sampled and then mass analysed.

From another aspect the present invention provides a mass spectrometer comprising an ion guide having a plurality of plate electrodes, one or more entrances for receiving ions and two or more exits from which ions emerge.

In the preferred embodiment the ion guide comprises one entrance for receiving ions and two exits from which ions emerge. In another embodiment the beam of ions entering an entrance of the ion guide is divided into three or more beams with the third beam exiting the ion, guide via a third exit. In yet a further preferred embodiment the ion guide comprises two entrances for receiving ions and two exits from which ions emerge. The mass spectrometer may further comprise at least two ion sources. A beam of ions entering an entrance of the ion guide may be divided into two or more beams with a first beam exiting the ion guide via a first exit and a second beam exiting via a second exit. Preferably the ions entering an entrance of the ion guide are divided into two or more beams by one or more electrode arranged adjacent to the entrance, one or more electrodes arranged within the ion guide or one or more electrodes arranged adjacent an exit of the ion guide.

An ion beam entering the ion guide may be divided into two or more beams in any desired ratio. Preferably, at least one beam comprises a percentage of the ions in the beam entering the ion guide which is either 0–10%, 10–20%, 20–30%, 30–40%, 40–50%, 50–60%, 60–70%, 70–80%, 80–90% or greater than 90%.

In the preferred embodiment at least part of a beam of ions entering the ion guide is switchable to or between one of a plurality of exits. At least one electrode may be arranged adjacent to one or more of the exits to either cause ions to exit the ion guide via that exit or substantially prevent ions from exiting the ion guide via that exit. One or more electrodes may also be provided adjacent the entrance or within the ion guide. According to an embodiment an ion beam may be switched between exits by applying and then removing a blocking DC potential to an electrode arranged adjacent an exit of the ion guide.

The mass spectrometer may further comprise a first ion detector disposed to receive ions exiting from a first exit and a second ion detector disposed to receive ions exiting from a second ion exit. The mass spectrometer may further comprises a first mass analyser disposed to receive ions exiting from the first exit and a second mass analyser disposed to receive ions exiting from the second ion exit.

The mass spectrometer may comprise one or more mass analysers disposed to receive ions exiting the ion guide from at least a first exit and one or more ion detectors disposed to receive ions exiting the ion guide from at least a second ion exit.

In another embodiment the mass spectrometer preferably comprises first and/or second ion storage devices, each having a plurality of plate electrodes. In a first mode of operation a beam of ions enters an ion storage device via a port and in a second mode of operation a beam of ions exits from the ion storage device via the same port.

An embodiment is also contemplated wherein the ion guide has two exits with an ion storage device arranged downstream of one exit and a mass analyser arranged downstream of another exit.

From another aspect the present invention provides a mass spectrometer comprising an ion guide having a plurality of plate electrodes, one or more entrances for receiving ions and one or more exits from which ions emerge. In a first mode of operation a beam of ions enters the ion guide via a first port and exits the ion guide via a second port and in a second mode of operation a beam of ions enters the ion guide via the second port.

In the preferred embodiment a beam of ions exits the ion guide via the first port in the second mode of operation. Alternatively, the beam of ions may exit the ion guide via a third port different from the first and second ports in the second mode of operation.

From a further aspect the present invention provides a mass spectrometer comprising an ion storage device having a plurality of plate electrodes, wherein in a first mode of operation a beam of ions enters the ion storage device via a port and in a second mode of operation a beam of ions exits from the ion storage device via the same port.

Other embodiments are contemplated wherein the ion storage device has two ports, a first port to receive ions and a second port from which ions leave the ion storage device.

From another aspect the present invention provides a mass spectrometer comprising an ion guide having a plurality of plate electrodes, an entrance for receiving ions and an exit from which ions emerge. The entrance has a first cross-sectional profile and a first cross-sectional area and the exit has a second cross-sectional profile and a second cross-sectional area. The first cross-sectional profile is different to the second cross-sectional profile and/or the first cross-sectional area is different to the second cross-sectional area.

The first and/or second cross-sectional profile may be substantially circular, oval, rectangular or square. An ion beam received by the ion guide has a third cross-sectional profile and a third cross-sectional area. Preferably the first cross-sectional profile and/or first cross-sectional area are substantially equal to the third cross-sectional profile and/or third cross-sectional area. The mass spectrometer may further comprise an ion-optical device downstream of the ion guide having a fourth cross-sectional profile and fourth cross-sectional area. The second cross-sectional profile and/or second cross-sectional area may be substantially equal to the fourth cross-sectional profile and/or fourth cross-sectional area. The ion-optical device may comprise an ion guide or quadrupole mass filter/analyser having substantially circular cross-sectional profiles. The ion guide may comprise a quadrupole, hexapole, octopole or higher order rod set, an ion tunnel comprising a plurality of electrodes having substantially the same size apertures or an ion funnel comprising a plurality of electrodes having progressively smaller apertures. The ion-optical device may comprise an orthogonal acceleration Time of Flight mass analyser or magnetic sector analyzer having substantially square or rectangular cross-sectional profiles.

According to other embodiments the ion-optical device may comprise a Fourier Transform Ion Cyclotron Resonance ("FTICR") mass analyser having a substantially circular cross-sectional profile, a 2D (linear) quadrupole ion trap having a substantially circular cross-sectional profile or a 3D (Paul) quadrupole ion trap having a substantially circular cross-sectional profile.

Reference is made above to the "cross-sectional area" and "cross-sectional profile". Whilst this is intended to cover the physical cross-sectional area and profile of a device or beam of ions, the terms should also be understood as covering the virtual acceptance area or profile of the device or beam of ions in an analogous manner to the numerical aperture of an optical device.

In a preferred embodiment the ion guiding region between at least one of the entrances and exits of the ion guide has a length which varies in size and/or shape. The ion guiding region may also have a length, width or height which progressively tapers in size or varies continuously in shape.

Preferably, the ion guide further comprises a second entrance for receiving ions and/or a second exit from which ions emerge from the ion guide, the second entrance having a fifth cross-sectional profile and a fifth cross-sectional area, the second exit having a sixth cross-sectional profile and a sixth cross-sectional area, wherein the fifth cross-sectional profile is different to the sixth cross-sectional profile and/or the fifth cross-sectional area is different to the sixth cross-sectional area.

Preferably, the first cross-sectional profile and the first cross-sectional area and/or the second cross-sectional profile and the second cross-sectional area and/or the fifth cross-sectional profile and the fifth cross-sectional area and/or the sixth cross-sectional profile and the sixth cross-sectional area are different.

In the above described embodiments at least 50%, 60%, 70%, 80%, 90% or 95% of the plate electrodes may be substantially parallel. According to the preferred embodiment the plate electrodes are arranged in a first (e.g. horizontal) plane and the ion guide is likewise curved in the same first (e.g. horizontal) plane. However, embodiments are also contemplated wherein the plate electrodes are not flat but are bent. In such embodiments the plates may initially be arranged in a first (e.g. horizontal) plane but the plate electrodes then bend in a second orthogonal (e.g. vertical) plane. According to this embodiment the plate electrodes may therefore act rather like a periscope and transfer ions from one (vertical) level to another.

The plate electrodes are preferably substantially equidistant from each other. However, according to less preferred embodiments the spacing between the electrodes may vary along the length of the ion guide. For example, the spacing between the electrodes may progressively decrease (increase) so that ions are funnelled from a relatively large (small) inlet orifice to a relatively small (large) outlet orifice. Other embodiments are contemplated wherein the spacing between the electrodes varies in a non-linear manner along the length of the ion guide.

The plurality of plate electrodes preferably comprises 2, 3, 4, 5, 6, 7, 8, 9, 10, 11, 12, 13, 14, 15, 16, 17, 18, 19, 20 or more than 20 plate electrodes. The plate electrodes of the preferred ion guide may have a thickness of less than or equal to 5 mm, less than or equal to 4.5 mm, less than or equal to 4 mm, lees than or equal to 3.5 mm, less than or equal to 3 mm, less than or equal to 2.5 mm, less than or equal to 2 mm, less than or equal to 1.5 mm, less than or equal to 1 mm, less than or equal to 0.8 mm, less than or equal to 0.6 mm, less than or equal to 0.4 mm, less than or equal to 0.2 mm, less than or equal to 0.1 mm, or less than or equal to 0.25 mm.

In one embodiment the plate electrodes may be formed by depositing a conductive paint or other substance on a substrate. In such embodiments the typical thickness of the deposited conductive (electrode) layer is approximately 250 $\mu$m (0.25 mm).

The plate electrodes of the preferred ion guide may be spaced apart from one another by a distance of less than or equal to 5 mm, less than or equal to 4.5 mm, less than or equal to 4 mm, less than or equal to 3.5 mm, less than or equal to 3 mm, less than or equal to 2.5 mm, less than or equal to 2 mm, less than or equal to 1.5 mm, less than or equal to 1 mm, less than or equal to 0.8 mm, less than or equal to 0.6 mm, less than or equal to 0.4 mm, less than or equal to 0.2 mm, less than or equal to 0.1 mm, or less than or equal to 0.25 mm.

In the preferred embodiment the plate electrodes are supplied with an AC or RF voltage. Adjacent plate electrodes may be supplied with opposite phases of the AC or RF voltage. The AC or RF voltage preferably has a frequency of <100 kHz, 100–200 kHz, 200–300 kHz, 300–400 kHz, 400–500 kHz, 0.5–1.0 MHz, 1.0–1.5 MHz, 1.5–2.0 MHz, 2.0–2.5 MHz, 2.5–3.0 MHz, 3.0–3.5 MHz, 3.5–4.0 MHz, 4.0–4.5 MHz, 4.5–5.0 MHz, 5.0–5.5 MHz, 5.5–6.0 MHz, 6.0–6.5 MHz, 6.5–7.0 MHz, 7.0–7.5 MHz, 7.5–8.0 MHz, 8.0–8.5 MHz, 8.5–9.0 MHz, 9.0–9.5 MHz, 9.5–10.0 MHz or >10.0 MHz.

The AC or RF voltage is preferably <50V peak to peak, 50–100V peak to peak, 100–150V peak to peak, 150–200V peak to peak, 200–250V peak to peak, 250–300V peak to peak, 300–350V peak to peak, 350–400V peak to peak, 400–450V peak to peak, 450–500V peak to peak, or >500V peak to peak.

Preferably, the ion guide is maintained, in use, at a pressure selected from the group consisting of: (i) greater than or equal to 0.0001 mbar; (ii) greater than or equal to 0.0005 mbar; (iii) greater than or equal to 0.001 mbar; (iv) greater than or equal to 0.005 mbar; (v) greater than or equal to 0.01 mbar; (vi) greater than or equal to 0.05 mbar; (vii) greater than or equal to 0.1 mbar; (viii) greater than or equal to 0.5 mbar; (ix) greater than or equal to 1 mbar; (x) greater than or equal to 5 mbar; and (xi) greater than or equal to 10 mbar.

Preferably, the ion guide is maintained, in use, at a pressure selected from the group consisting of: (i) less than or equal to 10 mbar; (ii) less than or equal to 5 mbar; (iii) less than or equal to 1 mbar; (iv) less than or equal to 0.5 mbar; (v) less than or equal to 0.1 mbar; (vi) less than or equal to 0.05 mbar; (vii) less than or equal to 0.01 mbar; (viii) less than or equal to 0.005 mbar; (ix) less than or equal to 0.001 mbar; (x) less than or equal to 0.0005 mbar: and (xi) less than or equal to 0.0001 mbar.

Preferably, the ion guide is maintained, in use, at a pressure selected from the group consisting of: (i) between 0.0001 and 10 mbar; (ii) between 0.0001 and 1 mbar; (iii) between 0.0001 and 0.1 mbar; (iv) between 0.0001 and 0.01 mbar; (v) between 0.0001 and 0.001 mbar; (vi) between 0.001 and 10 mbar; (vii) between 0.001 and 1 mbar; (viii) between 0.001 and 0.1 mbar; (ix) between 0.001 and 0.01 mbar; (x) between 0.01 and 10 mbar; (xi) between 0.01 and 1 mbar; (xii) between 0.01 and 0.1 mbar; (xiii) between 0.1 and 10 mbar; (xiv) between 0.1 and 1 mbar; and (xv) between 1 and 10 mbar.

Preferably, the ion guide is maintained, in use, at a pressure selected from the group consisting of: (i) greater than or equal to $1\times10^{-7}$ mbar; (ii) greater than or equal to $5\times10^{-7}$ mbar; (iii) greater than or equal to $1\times10^{-6}$ mbar; (iv) greater than or equal to $5\times10^{-6}$ mbar; (v) greater than or equal to $1\times10^{-5}$ mbar; and (vi) greater than or equal to $5\times10^{-5}$ mbar.

Preferably, the ion guide is maintained, in use, at a pressure selected from the group consisting of: (i) less than or equal to $1\times10^{-4}$ mbar; (ii) less than or equal to $5\times10^{-5}$ mbar; (iii) less than or equal to $1\times10^{-5}$ mbar; (iv) less than or equal to $5\times10^{-6}$ mbar; (v) less than or equal to $1\times10^{-6}$ mbar; (vi) less than or equal to $5\times10^{-7}$ mbar; and (vii) less than or equal to $1\times10^{-7}$ mbar.

Preferably, the ion guide is maintained, in use, at a pressure selected from the group consisting of: (i) between $1\times10^{-7}$ and $1\times10^{-4}$ mbar; (ii) between $1\times10^{-7}$ and $5\times10^{-5}$ mbar; (iii) between $1\times10^{-7}$ and $1\times10^{-5}$ mbar; (iv) between $1\times10^{-7}$ and $5\times10^{-6}$ mbar; (v) between $1\times10^{-7}$ and $1\times10^{-6}$ mbar; (vi) between $1\times10^{-7}$ and $5\times10^{-7}$ mbar; (vii) between $5\times10^{-7}$ and $1\times10^{-4}$ mbar; (viii) between $5\times10^{-7}$ and $5\times10^{-5}$ mbar; (ix) between $5\times10^{-7}$ and $1\times10^{-5}$ mbar; (x) between $5\times10^{-7}$ and $5\times10^{-6}$ mbar; (xi) between $5\times10^{-7}$ and $1\times10^{-6}$ mbar; (xii) between $1\times10^{-6}$ mbar and $1\times10^{-4}$ mbar; (xiii) between $1\times10^{-6}$ and $5\times10^{-5}$ mbar; (xiv) between $1\times10^{-6}$ and $1\times10^{-5}$ mbar; (xv) between $1\times10^{-6}$ and $5\times10^{-6}$ mbar; (xvi) between $5\times10^{-6}$ mbar and $1\times10^{-4}$ mbar; (xvii) between $5\times10^{-6}$ and $5\times10^{-5}$ mbar; (xviii) between $5\times10^{-6}$ and $1\times10^{-5}$ mbar; (xix) between $1\times10^{-5}$ mbar and $1\times10^{-4}$ mbar; (xx) between $1\times10^{-5}$ and $5\times10^{-5}$ mbar; and (xxi) between $5\times10^{-5}$ and $1\times10^{-4}$ mbar.

The ion guide preferably further comprises a first outer (e.g. top/upper) plate electrode arranged on a first side of the ion guide and a second (e.g. bottom/lower) outer plate electrode arranged on a second side of the ion guide. According to less preferred embodiments no upper or lower plate electrodes may be provided. In such embodiments ions may be prevented from escaping from the top or bottom of the ion guide by AC or RF confinement provided by other means such as an adjacent rod set arrangement.

According to another embodiment the plate electrodes away from the middle of the ion guide may be maintained at progressively increasing positive or negative DC potentials so that ions moving away from the central region of the ion guide are progressively urged back towards the middle of the ion guide. According to this embodiment no outer plate electrodes which enclose the ion guide may by provided.

The first outer plate electrode and/or the second outer plate electrode may be arranged to be biased at a bias DC voltage with respect to the mean voltage of the plate electrodes to which an AC or RF voltage is applied.

This bias voltage is preferably less than −10V, −9 to −8V, −8 to −7V, −7 to −6V, −6 to −5V, −5 to −4V, −4 to −3V, −3 to −2V, −2 to −1V, −1 to 0V, 0 to 1V, 1 to 2V, 2 to 3V, 3 to 4V, 4 to 5V, 5 to 6V, 6 to 7V, 7 to 8V, 8 to 9V, 9 to 10V, or more than 10V.

According to one embodiment the top and/or bottom plates i.e. outer electrodes are supplied with a DC only voltage (i.e. no AC or RF voltage is applied to them). In another embodiment the top and/or bottom plates are supplied with an AC or RF only voltage (i.e. the plates are not biased with a DC voltage relative to the other plate electrodes). In yet a further embodiment the top and/or bottom plates are supplied with both a DC and an AC or RF voltage (i.e. the outer electrodes are DC biased relative to the other electrodes and are also supplied with an AC or RF voltage).

In the embodiments described above the ion guide may further comprise a port arranged in the upper and/or lower plate. The port may be used for allowing ions and/or gas and or a laser beam to pass into and/or out of the ion guide.

According to an embodiment one or more of said plate electrodes are maintained in use at a different DC potential to the other plate electrodes so that a plurality of discrete ion guiding regions are formed within said ion guide. For example, one or more of the plate electrodes towards the middle of the stack of plate electrodes may be maintained at a DC potential such that it forms a potential barrier. According to such an arrangement two parallel and longitudinally extending ion guiding regions may then formed within the ion guide e.g. an upper ion guiding region and a lower ion guiding region. According to other embodiments more than two parallel ion guiding regions may be formed.

According to another embodiment a plurality of the plate electrodes are maintained at substantially different DC potentials. According to such embodiments a DC potential profile may be maintained between the plates. For example, a V-shaped DC potential profile may be maintained between the plate electrodes such that ions are urged towards the central region of the ion guide. According to this embodiment upper and lower plate electrodes which effectively enclose the ion guide may not need to be provided i.e. the ion guide may appear essentially open from the top and bottom.

Preferably, the ion guide comprises a first outer portion, a second outer portion and an intermediate portion between the first and second outer portions and wherein the DC potential at which the plate electrodes are maintained is increased in the first and/or second outer portions relative to the intermediate portion so that ions are directed back towards a central region of the ion guide.

Further embodiments are contemplated wherein the DC potentials applied to the plate electrodes may vary with time.

Preferably, one or more transient DC potentials or one or more DC potential waveforms are applied to the plate electrodes. This may preferably have the effect of urging ions from one region (e.g. an upper region) of the ion guide to another region (e.g. a lower region) of the ion guide.

According to another aspect of the present invention there is provided a mass spectrometer comprising an ion guide, the ion guide comprising:

a plurality of electrode layers; and a plurality of insulator layers interspersed or interleaved between the electrode layers.

Preferably, at least 10%, 20%, 30%, 40%, 50%, 60%, 70%, 80%, 90% or 95% of the electrode layers are arranged on or are deposited on the insulator layers.

According to another aspect of the present invention there is provided a mass spectrometer comprising an AC or RF ion guide, the ion guide comprising:

a plurality of electrodes;

a plurality of insulators interspersed or interleaved between the electrodes;

wherein the electrodes are mounted on or deposited on the insulators.

Preferably, the ion guide has an ion entrance and an ion exit and wherein gas molecules within the ion guide are substantially prevented from exiting the ion guide other than through the ion entrance or the ion exit. A gas port for introducing gas into the ion guide may be provided but gas may preferably be essentially prevented from exiting the ion guide via this gas port.

From a further aspect the present invention provides a mass spectrometer comprising a first ion guide, a gas collision/reaction cell and a second ion guide. The second ion guide has a plurality of plate electrodes, an entrance for receiving ions, an ion guiding region through the ion guide and an exit from which ions emerge. There is preferably no direct line of sight from the entrance to the exit of the second ion guide.

In the preferred embodiment the mass spectrometer further comprises an Electrospray ("ESI") ion source, an Atmospheric Pressure Chemical Ionisation ("APCI") ion source, an Atmospheric Pressure Photo Ionisation ("APPI") ion source, a Matrix Assisted Laser Desorption Ionisation ("MALDI") ion source, a Laser Desorption Ionisation ("LDI") ion source, an Inductively Coupled Plasma ("ICP") ion source, an Electron Impact ("EI") ion source, a Chemical Ionisation ("CI") ion source, a Fast Atom Bombardment ("FAB") ion source, or a Liquid Secondary Ions Mass Spectrometry ("LSIMS") ion source.

The mass spectrometer may also comprise a mass analyser arranged downstream of the second ion guide. The mass analyser may comprise a Time of Flight mass analyser, a quadrupole mass analyser, a Penning or Fourier Transform Ion Cyclotron Resonance ("FTICR") mass analyser, a 2D (linear) quadrupole ion trap, a 3D (Paul) quadrupole ion trap or a magnetic sector analyser.

Ion guides according to the preferred embodiment may advantageously have an ion guiding region having at least a curved or non-linear portion and may have more than one ion entrance and/or ion exit. It would be very difficult and prohibitively expensive to attempt to manufacture and construct equivalent ion guides from conventional multipole rod set RF ion guides.

The ion guide according to the preferred embodiment is constructed from a series of shaped plates or plate electrodes. The plates are not required to be straight and may have more than one ion entrance and/or ion exit. The preferred ion guides are relatively simple to manufacture and are significantly less expensive than conventional multipole rod set ion guides. Ion guides having intricate shapes can also be easily manufactured. For example, multiple identical plates with intricate shapes may be easily and inexpensively manufactured from thin sections of sheet metal by pressure cutting or stamping, photo-chemical etching, laser cutting, wire erosion, spark erosion, etc. Furthermore, the plates may be stacked in an assembly or array where the plates are spaced apart and insulated and wherein alternate plates are electrically connected to one another so that adjacent plates are maintained 180° out of phase with each other.

In a preferred embodiment the RF ion guide is constructed from a series of shaped plates arranged in a stack with appropriate DC potentials applied to a top or upper plate electrode and to a bottom or lower flat plate electrode. This provides a particularly simple and inexpensive way of constructing a complex RF ion guide. The top and bottom plates may be operated with an AC or RF voltage applied to them or a combination of AC or RF and DC voltages.

In the preferred embodiment the plates may be designed with an entrance and exit that are not aligned i.e. there is no line of sight through the ion guide so that neutral particles, large particles or droplets, or radiation such as visible or UV light does not pass straight through the ion guide.

According to another aspect of the present invention there is provided a method of mass spectrometry comprising:

generating ions from an atmospheric pressure ion source; and guiding the ions through an ion guide, the ion guide comprising a plurality of plate electrodes and having an entrance for receiving ions and an exit from which ions emerge from the ion guide wherein an ion guiding channel is provided in the plate electrodes and runs substantially the length of the ion guide and wherein the plate electrodes are arranged in the plane of ion travel.

According to another aspect of the present invention there is provided a method of manufacturing an ion guide for a mass spectrometer, comprising:

interspersing or interleaving a plurality of electrodes with a plurality of insulators to form an ion guide having a plurality of electrodes arranged on the insulators to form an ion guide stack.

According to another aspect of the present invention there is provided a method of manufacturing an ion guide for a mass spectrometer, comprising:

depositing a plurality of electrode layers on a plurality of insulator layers to form an ion guide having a plurality of electrode layers arranged on top of the insulator layers.

The term "plate electrode" used throughout the present application is intended to be construed broadly. According to a preferred embodiment the plate electrodes comprise thin metal sheets. However, according to other embodiments the plate electrodes may comprise wire meshes or grids and hence have apertures in the plate electrodes. The term is also intended to cover electrodes which have been deposited on a substrate such as an insulator.

According to the preferred embodiment the electrodes forming the ion guide are arranged in the plane of ion travel in contrast to an ion tunnel or ion funnel ion guide wherein the ring electrodes are arranged in a plane orthogonal to the direction of ion travel.

The ion guides described above may either be used as an ion guide per se or may form a fragmentation, collision, reaction or collisional cooling cells.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Various different embodiments of the present invention will be described. However, a common feature of the various embodiments is that an AC or RF ion guide is provided which comprises a plurality of plate electrodes. The plate electrodes are preferably relatively thin and may be formed from metal sheets. Alternatively, the plate electrodes may be formed from a non-conductive plate, such as glass or ceramic, which is then at least partially coated with an electrically conductive coating. The glass or ceramic plate may be shaped in the same manner as the metal sheets to provide an ion guiding region.

The glass or ceramic plates are preferably continuous and may have areas of the surface painted with the conductive coating to provide shaped electrodes for guiding the ions.

The preferred plate electrodes differ from conventional rod set electrodes which have a circular cross-sectioned profile and which normally have a length which is much greater than their width. In contrast, the plate electrodes forming the ion guide according to the preferred embodiment preferably have a rectangular cross-sectional profile and the width of the electrodes may be comparable with (or even wider than) the length of the electrodes.

Figure 1A:
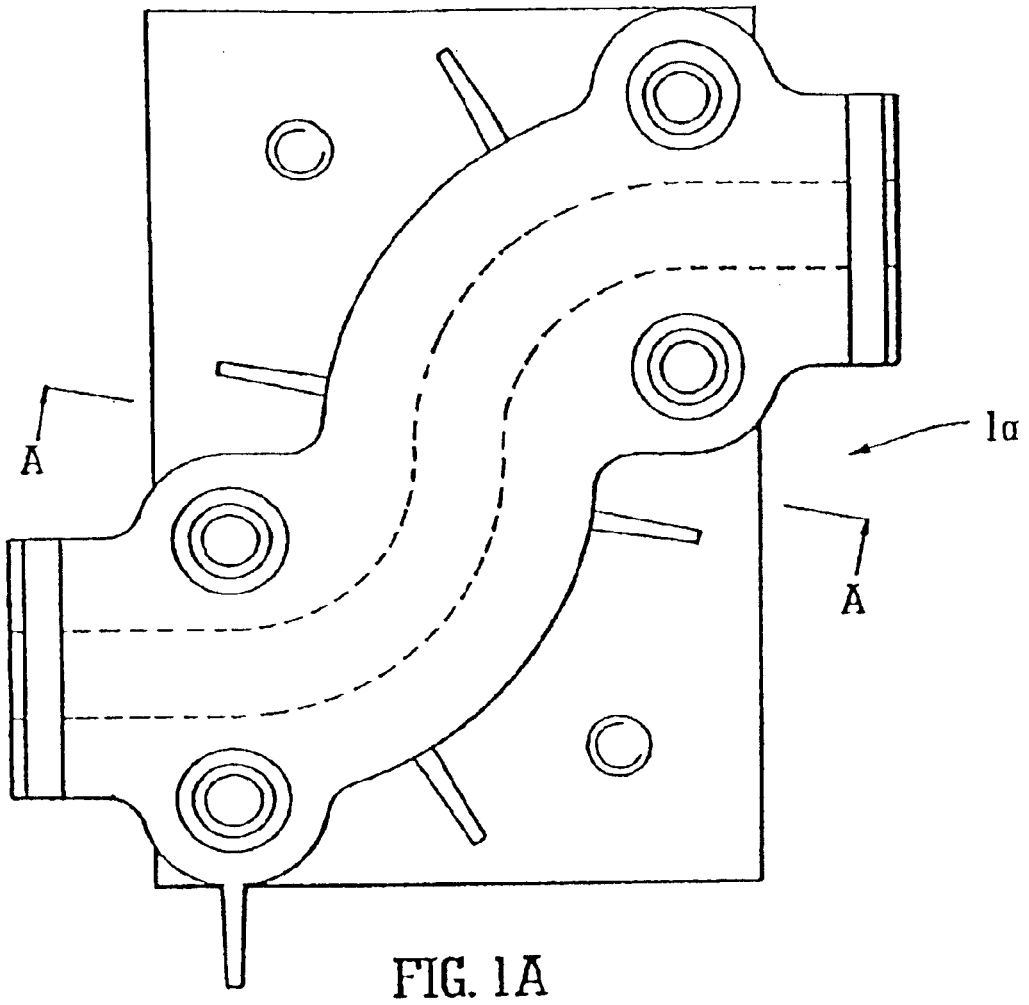
FIG. 1A shows a plan view of an AC or RF ion guide according to one embodiment and FIG. 1B shows a cross sectional view of the ion guide of FIG. 1A along section A—A.

FIG. 1A shows a plan view of an AC or RF ion guide 1*a* constructed from a stack of plate electrodes such that an S-shaped ion path is formed within the AC or RF ion guide 1*a*. The AC or RF ion guide 1*a* is preferably made from a series of identical plates each approximately 0.7 mm thick and preferably spaced 1.0 mm apart from each other.

Figure 1B:
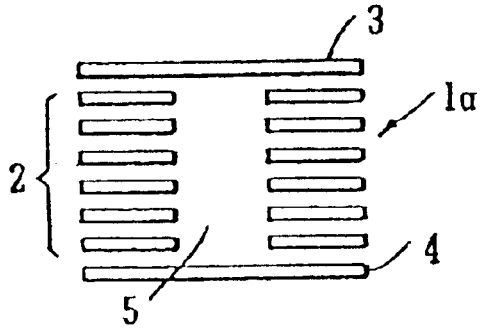

FIG. 1B is a cross-sectional view along A—A of the ion guide shown in FIG. 1A and shows an AC or RF ion guide 1*a* comprising a stack of six plate electrodes 2 with an upper plate electrode 3 and a lower plate electrode 4. The internal opening or ion guiding region 5 within the ion guide 1*a* is preferably 11.2 mm high by 5 mm wide. The ion path length through the ion guide 1*a* as shown in FIG. 1A may be approximately 60 mm. The frequency of the RF supply applied to the plates 2, 3, 4 forming the ion guide 1*a* may be 6 MHz and the RF voltage may be 200 V peak to peak. The top or upper plate electrode 3 and the bottom or lower plate electrode 4 may in one embodiment be biased at 3V positive with respect to the mean voltage of the shaped plate electrodes 2 to which the AC or RF voltage was applied.

The preferred AC or RF ion guide 1*a* preferably comprises a plurality of plate electrodes 2 arranged in a stack or array. The ion guide 1*a* preferably comprises an upper plate electrode 3 and a lower plate electrode 4. The electrodes 2 other than the upper plate electrode 3 and the lower plate electrode 4 preferably have a channel provided in the plates along substantially the whole of their length. In the example shown in FIG. 1A the plate electrodes 2 and the upper and lower plate electrodes 3,4 are S-shaped. The channel formed in each of the plate electrodes 2 results in an ion guiding region 5 being provided within the ion guide 1*a*.

Having now described the basic arrangement of the ion guide 1*a*, various different embodiments will now be described in more detail.

Figure 2:
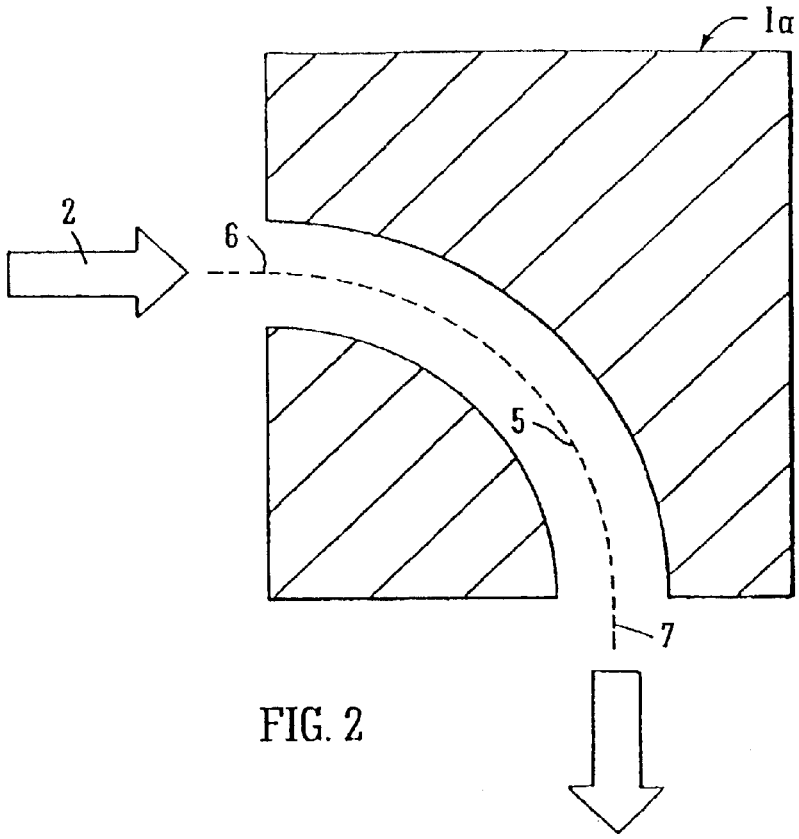
FIG. 2 shows an embodiment wherein the plates have a C-shaped ion path so that the ions are rotated by 90° from the entrance to the exit.
Figure 3:
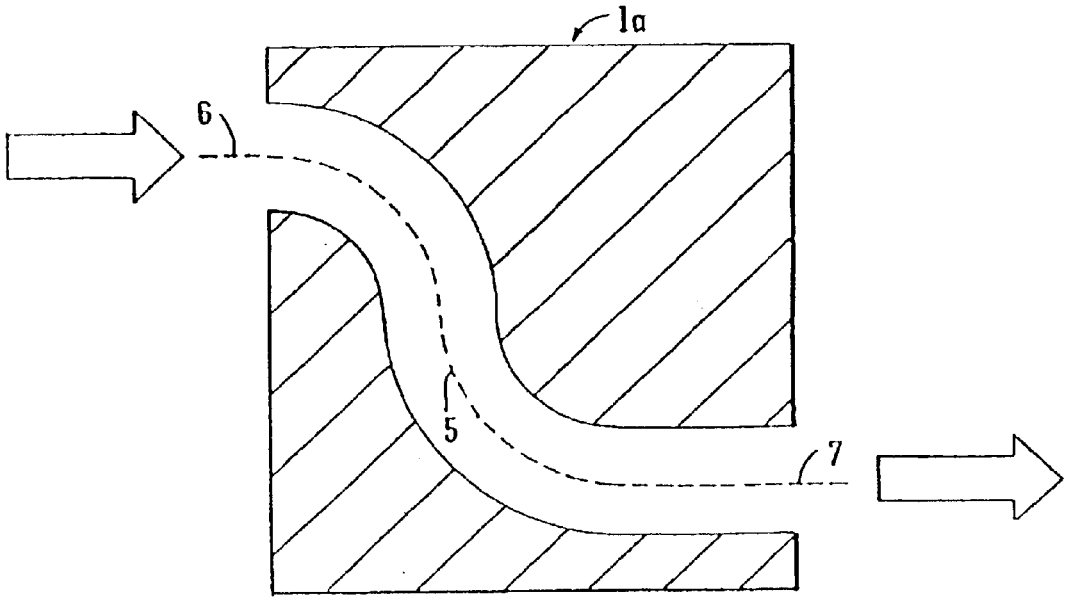
FIG. 3 shows an embodiment wherein the plates have an S-shaped ion path so that ions are laterally displaced from the entrance to exit.
Figure 4:
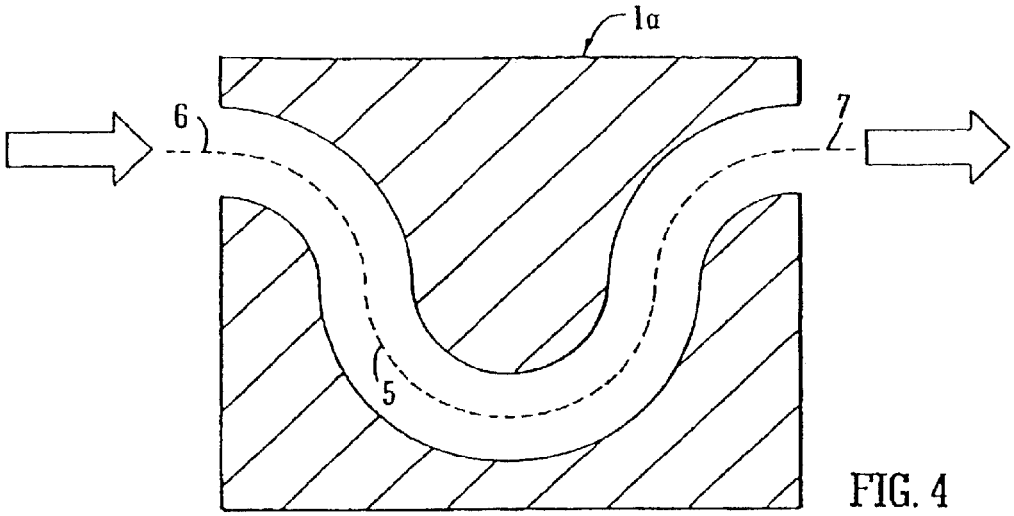
FIG. 4 shows an embodiment wherein the plates have an Ω-shaped ion path such that there is no line-of-sight between the entrance and exit but wherein the ions are not laterally or angularly displaced on exiting the ion guide.

A first main embodiment of the present invention will now be described with reference to FIGS. 2–4 which show various different arrangements of an AC or RF ion guide 1*a*. Curved or otherwise non-linear channels are provided in the plate electrodes 2 other than the upper and lower plate electrodes 3,4. The ion guide 1*a* has an entrance 6 and an exit 7 and the ion guiding region 5 is arranged so that there is no line of sight between the ion entrance 6 and exit 7 ports. This is advantageous in that radiation, neutral particles or droplets arriving at the entrance 6 to the ion guide 1*a* are not angularly or laterally displaced by the ion guide 1*a* and hence in the embodiments shown in FIGS. 2 and 3 do not exit the ion guide 1*a* via exit 7. In the embodiment shown in FIG. 4 a device may be arranged outside of the ion guiding region 5 to block radiation, neutral particles or droplets passing directly from the entrance 6 to the exit 7. This device may comprise a baffle, plate or electrode.

The ion guide 1*a* may preferably be operated at intermediate pressures e.g. between 0.0001 and 10 mbar. The presence of the gas will result in frequent ion-molecule collisions and this can cause ions to slow and possibly even come to a standstill within the ion guide 1*a*.

Figure 5:
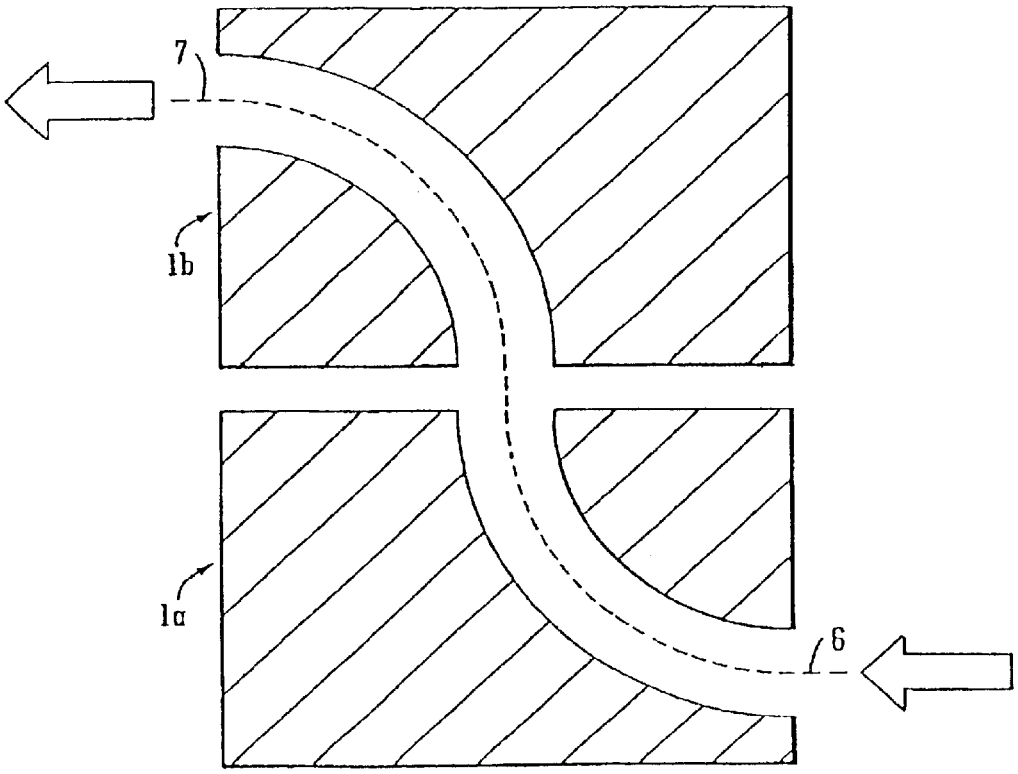
FIG. 5 shows an embodiment having an S-shaped ion path formed from two stacks of plates having C-shaped ion paths.
Figure 6:
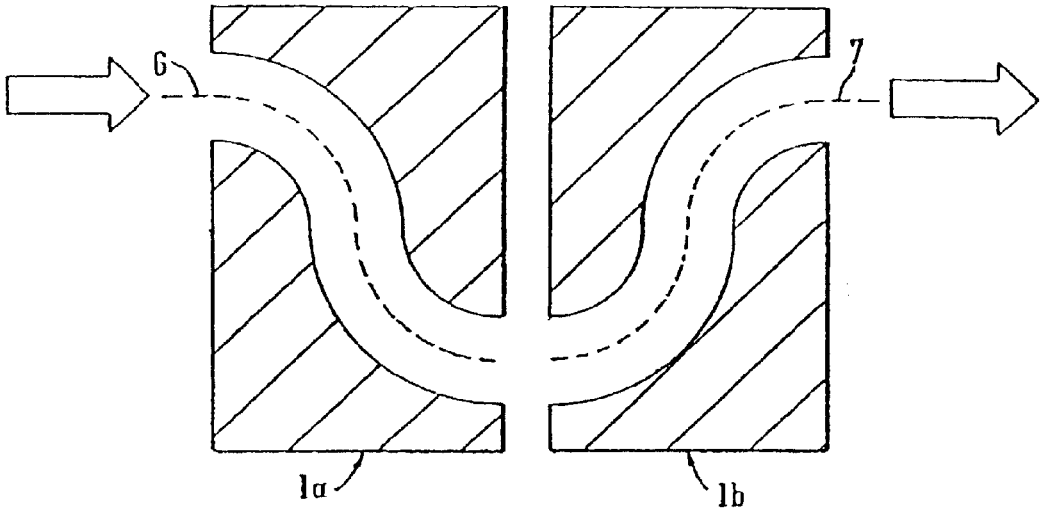
FIG. 6 shows an embodiment having an Ω-shaped ion path formed from two stacks of plates having S-shaped ion paths.

A second main embodiment of the present invention will now be described with reference to FIGS. 5–7. According to the second main embodiment two or more AC or RF ion guides 1*a*,1*b* are provided, each ion guide 1*a*, 1*b* comprising a stack of plate electrodes. Each plate electrode 2 is shaped to provide a path for the ions to be guided through. A DC potential may be applied between the region at which the ions leave one ion guide 1*a* and then enter a neighbouring ion guide 1*b*. The DC potential may create an axial field which helps to keep ions moving through the ion guides 1*a*,1*b* in the presence of a gas.

Figure 7:
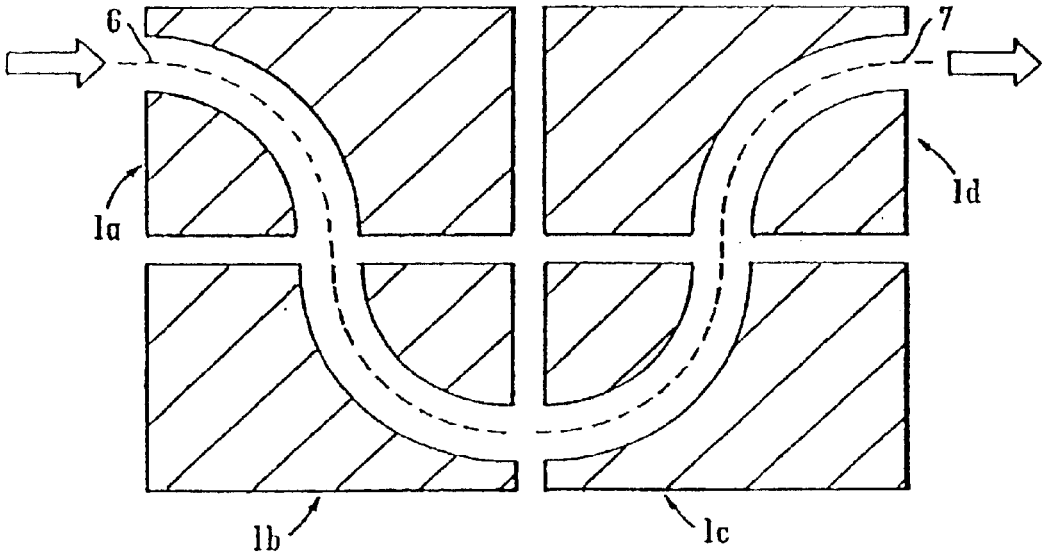
FIG. 7 shows an embodiment having an Ω-shaped ion path formed from four stack of plates having C-shaped ion paths.

With the embodiment shown in FIG. 7 a potential well may be created along the ion beam axis. Ions may, for example, be trapped within the second or third ion guides 1*b*,1*c*. The potential applied in the region between the exit of the first ion guide 1*a* and entrance of the second ion guide 1*b* and that applied in the region between the exit of the second ion guide 1*b* and the entrance of the third ion guide 1*c* may be chosen so that in one mode of operation ions are trapped within the second ion guide 1*b*. In a similar manner ions could be arranged to be trapped in the third ion guide 1*c*. Other embodiments are also contemplated wherein ions are trapped within the second 1*b* and third 1*c* ion guides. Ions may be trapped within a particular ion guide 1*a*,1*b*,1*c* by maintaining the downstream ion guide 1*b*,1*c*,1*d* at a different DC potential.

A third main embodiment of the present invention will now be described with reference to FIGS. 8–12. According to the third main embodiment two or more entrances to the ion guide 1*a* may be provided with the ion guide having one or more exits. Alternatively, the ion guide 1*a* may have one or more entrances and two or more exits. In contrast, conventional multipole rod set ion guides have only a single ion entrance and a single ion exit.

FIGS. 8–11 show embodiments wherein the ion guide 1*a* has two entrances 6*a*,6*b* and wherein it is possible to switch between receiving ions from one entrance 6*a* to receiving ions from another entrance 6*b*. Alternatively, two or more ion beams may be merged. The ion entrances may be disposed at angles in the range 0–10°, 10–20°, 20–30°, 30–40°, 40°–50°, 50–60°, 60–70°, 70–80°, 80–90°, 90–100°, 100–110°, 110–120°, 120–130°, 130–140°, 140–150°, 150–160°, 160–170°, or 170–180° to each other.

The ion guide 1*a* may be used with a first ion source (not shown) for analysing analyte ions and a second ion source (not shown) for generating reference ions. Alternatively, the ion guide 1*a* may be used with two different types of ion source e.g. the ion guide 1*a* may be used in conjunction with an Atmospheric Pressure Ionisation ("API") and a Matrix Assisted Laser Desorption Ionisation ("MALDI") ion source. The plate electrodes may be formed to any shape such that ion beams can be received by the ion guide or exit the ion guide at any angle or from any direction.

Figure 8:
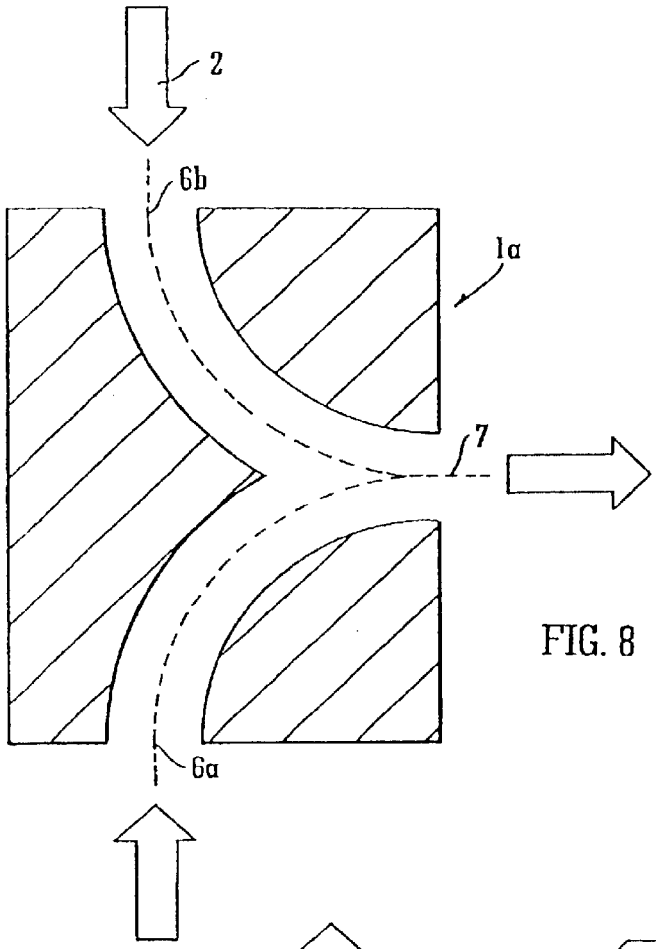
FIG. 8 shows an embodiment wherein the ion guide has two entrances and one exit.
Figure 9:
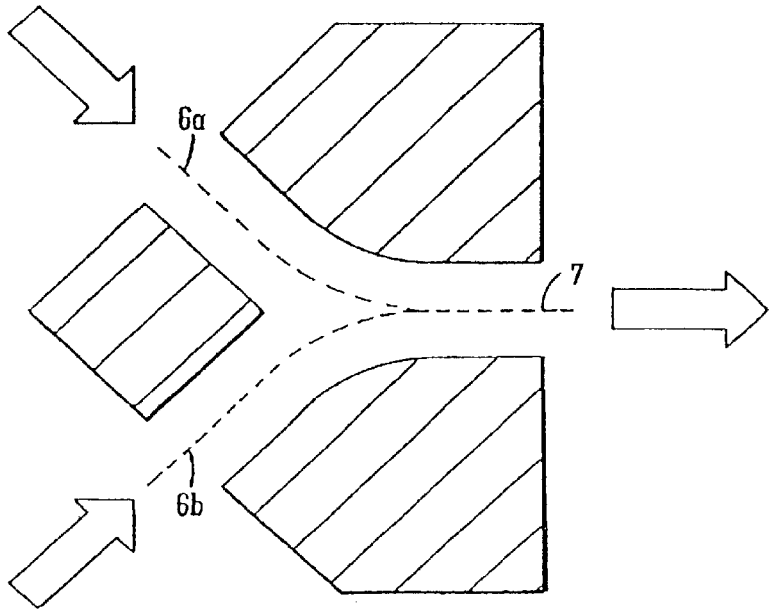
FIG. 9 shows another embodiment wherein the ion guide has two entrances and one exit.
Figure 10:
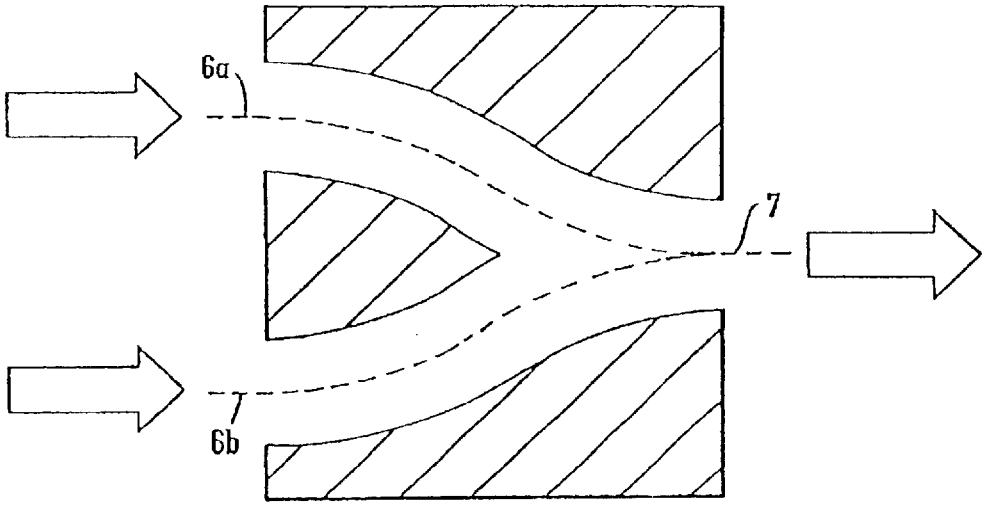
FIG. 10 shows another embodiment wherein the ion guide has two entrances and one exit.
Figure 11:
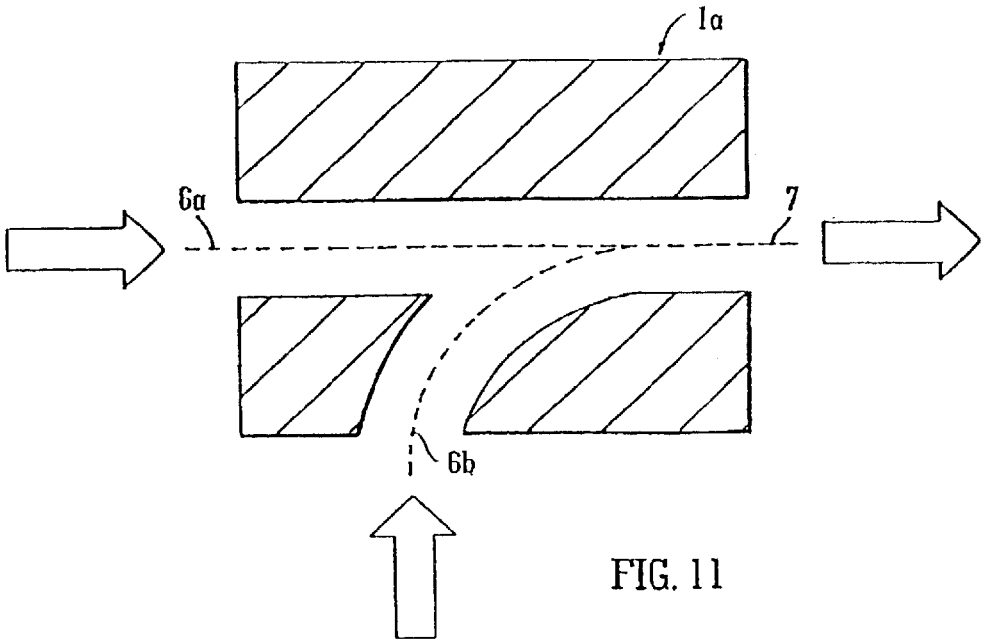
FIG. 11 shows another embodiment wherein the ion guide has two entrances and one exit.

In the embodiment shown in FIG. 8 the plate electrodes of the ion guide are shaped such that the two entrances are on opposite sides of the plates and the exit is on a third side. The plate electrodes may be substantially rectangular or square. FIG. 9 shows an embodiment wherein the plates are shaped such that the entrances are at right angles to each other so that in use the ion beams received by the entrances are both angled with respect to the ion beam exiting the ion guide. Alternatively, the entrances may be in the same side of the plate with the exit on a second side as shown in FIG. 10. FIG. 11 shows another embodiment wherein one of the entrances and the exit are on opposite sides of the plate, directly opposite each other, and a second entrance is on a third side.

Figure 12:
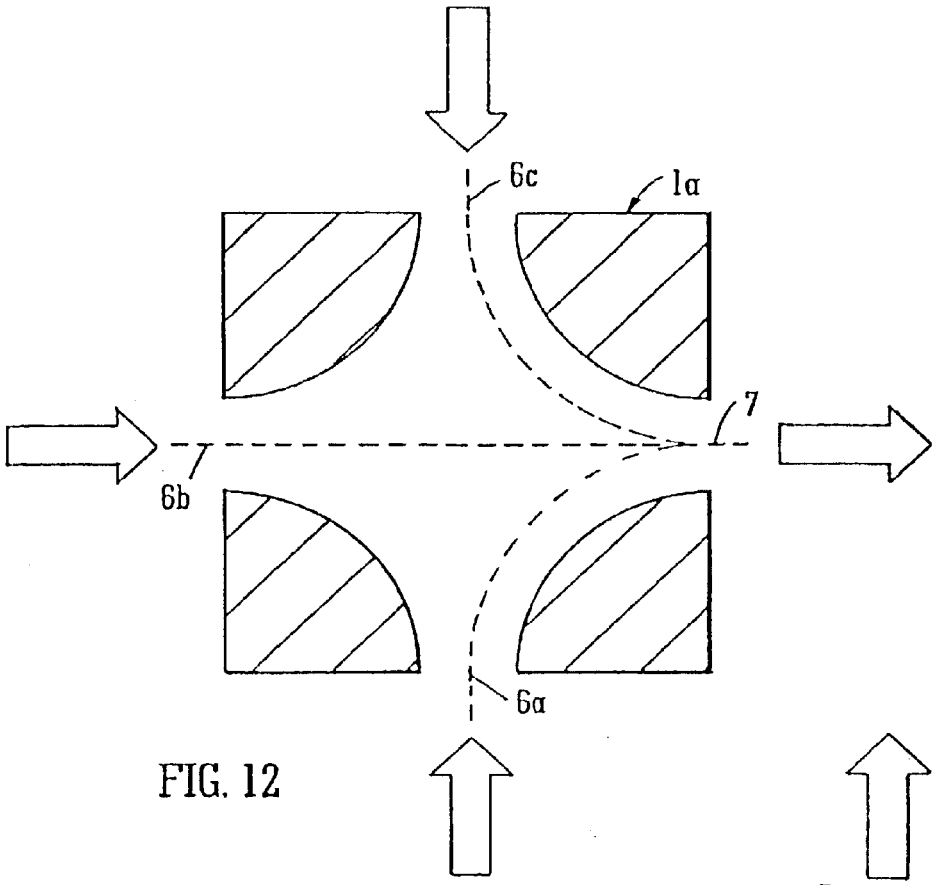
FIG. 12 shows an embodiment wherein the ion guide has three entrances and one exit.

FIG. 12 shows an embodiment wherein the AC or RF ion guide 1*a* has three entrances 6*a*,6*b*,6*c*. Other embodiments are contemplated wherein four or more entrances may be provided. The ion guide 1*a* shown in FIG. 12 may be used to switch between or merge ion beams from, for example, two different ion sources for analysing analyte ions and a third ion source for generating reference ions.

An AC or RF ion guide 1*a* having a plurality of ion entrances 6*a*,6*b*,6*c* may be used to multiplex between different ion sources within an array of ion sources. Such an arrangement allows parallel analysis from a large number of sample streams e.g. from four to eight different liquid or gas flows from four to eight different liquid or gas chromatography columns.

Figure 13:
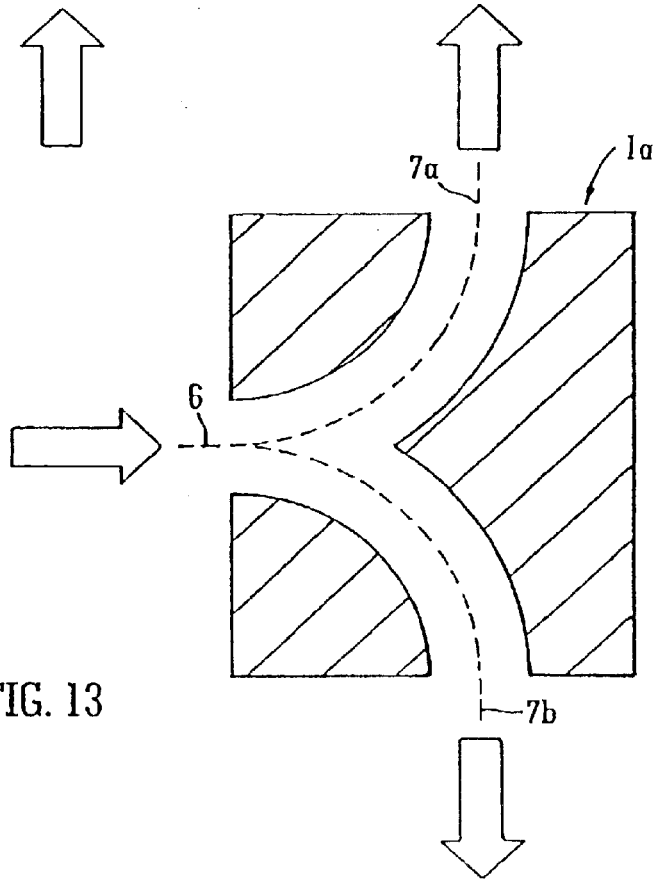
FIG. 13 shows an embodiment wherein the ion guide has one entrance and two exits.

A fourth main embodiment of the present invention will now be described with reference to FIGS. 13–16. Ion guides 1*a* such as the one shown in FIG. 13 are contemplated having more than one exit 7*a*,7*b* such that a stream of ions may be divided between two or more exits or switched between two or more exits. Such an embodiment may be used, for example, to divide or switch ions between two detectors. Ions may, for example, be divided or switched between a Faraday cup detector and an ion counting detector to provide a detection system with a very wide dynamic range and yet the capability of detecting and counting single ions.

Alternatively, such an ion guide 1*a* may be used to divide or switch ions between a detector and another analyser such as a mass analyser. For example, ions may be divided such that part of the ion signal is monitored on a detector while the remaining part is transmitted to a device for further analysis, such as a collision cell and mass analyser for ion structural determination studies or ion monitoring with greater specificity Alternatively, such an ion guide 1*a* may be used to divide or switch ions between two mass analysers. For example, ions may be divided between two mass analysers operating at different resolutions or between two mass analysers tuned to different masses.

The embodiment shown in FIG. 13 may be used to divide an ion beam into two ion beams to be directed to two or more different mass analysers and may provide a means of measuring isotope ratios. The mass analysers may be tuned to the appropriate masses to measure any desired isotope ratio. This embodiment is the reverse of that shown in FIG. 8 wherein an AC or RF ion guide 1*a* is provided with two entrances 6*a*, 6*b* and a single exit 7.

All the embodiments shown in FIGS. 8–12 may be reversed to have a single entrance and two (or more) exits.

Figure 14:
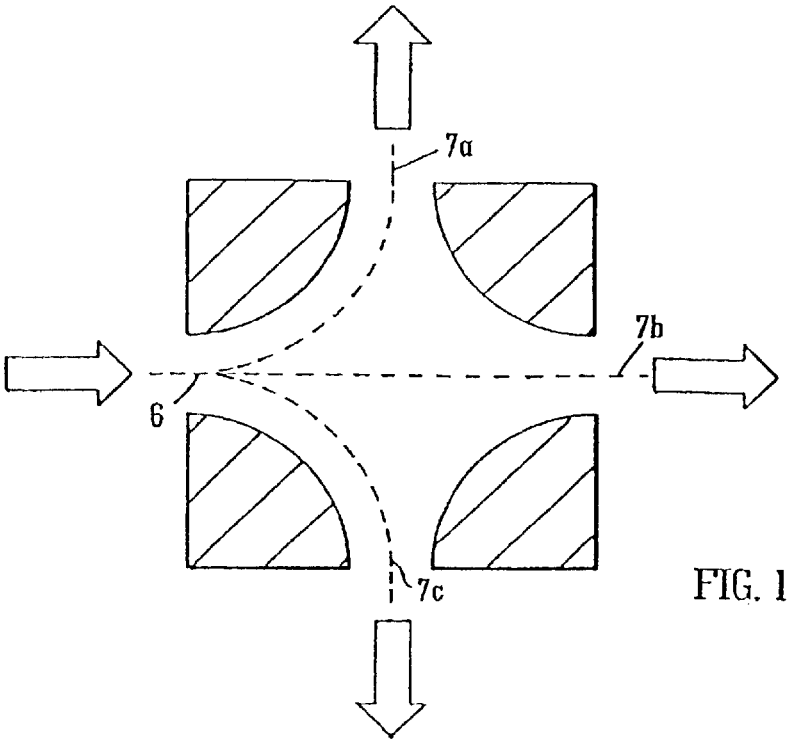
FIG. 14 shows an embodiment wherein the ion guide has one entrance and three exits.

FIG. 14 shows an embodiment wherein the AC or RF ion guide 1*a* has three exits 7*a*,7*b*,7*c*. Other embodiments are contemplated wherein more than three exits are provided. The embodiment shown in FIG. 14 with three exits 7*a*,7*b*,7*c* allows a stream of ions to be switched or divided between different detectors and/or mass analysers in any combination.

Figure 15:
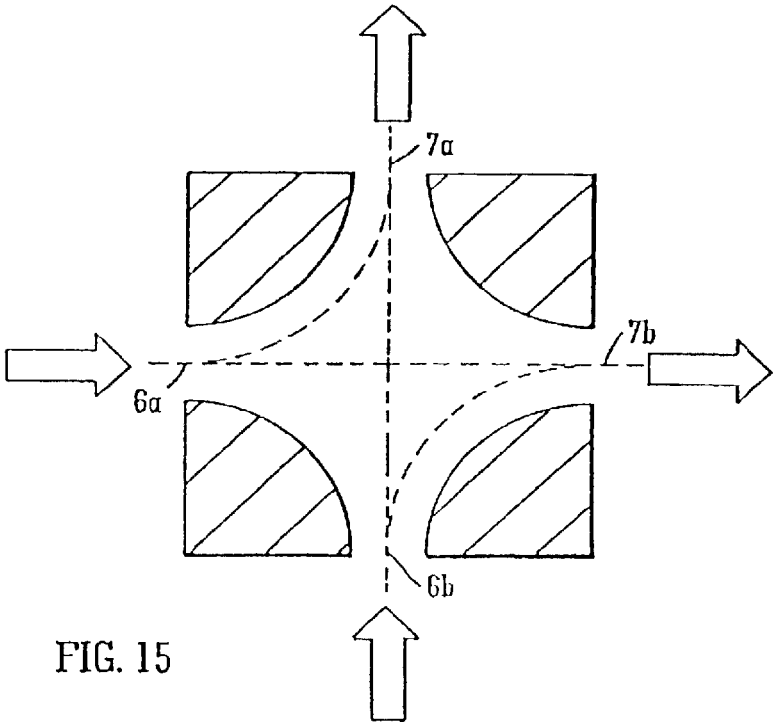
FIG. 15 shows an embodiment wherein the ion guide has two entrances and two exits.

Embodiments are contemplated wherein the AC or RF ion guide 1*a* comprises a plurality of entrances and a plurality of exits. FIG. 15, for example, shows an embodiment wherein an ion guide 1*a* is provided having two entrances 6*a*,6*b* and two exits 7*a*,7*b*. According to this embodiment the ion guide 1*a* may receive ions from two different ion sources such as a Thermal Ionisation ion source and an Inductively Coupled Plasma ("ICP") ion source. The ions may then be directed to two different mass analysers each tuned to two different isotope mass to charge ratios.

Figure 16A:
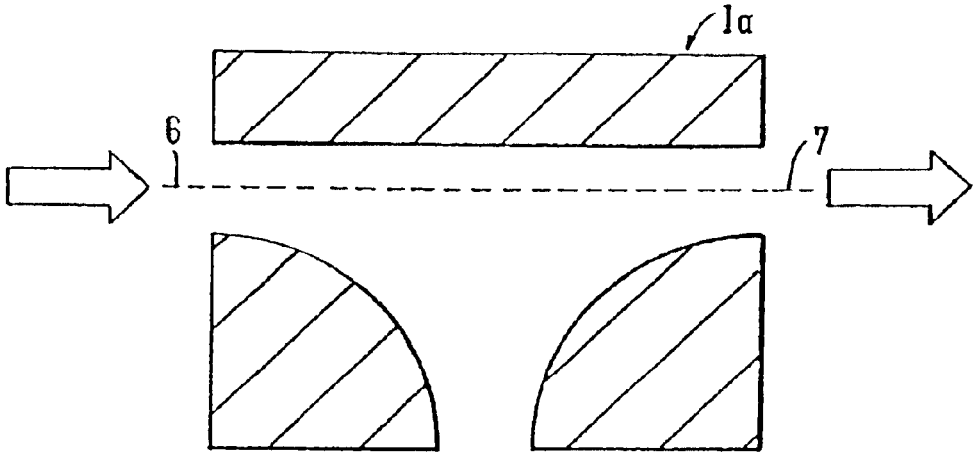
FIG. 16A shows an embodiment wherein the ion guide has three ports which may be selectively used as entrances and exits and FIG. 16B shows the same ion guide used in a different mode of operation.
Figure 16B:
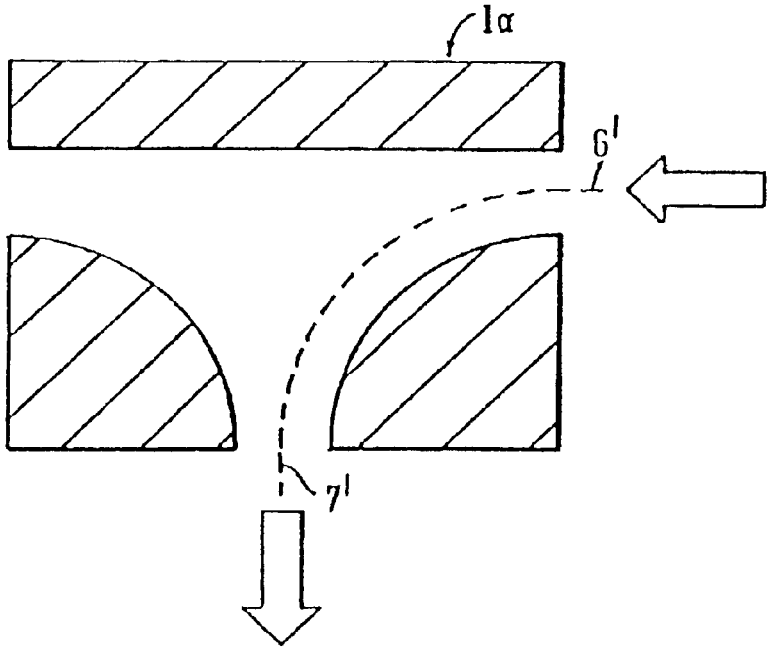

Embodiments are also contemplated wherein the AC or RF ion guide 1*a* having multiple inlets and/or outlets may be used wherein ions pass one way in one mode of operation and pass the other way in another mode of operation. For example, with the embodiment shown in FIGS. 16A and 16B the port 7 shown in FIG. 16A acts as an exit port in the mode of operation shown in FIG. 16A but as shown in FIG. 16B the same port (now referred to as 6') may act as an entrance port in a subsequent mode of operation. In the subsequent mode of operation ions exit the ion guide 1*a* via a third port 7'.

Ion guides 1*a* are contemplated wherein streams of ions may be directed back and forth within an overall arrangement of ionisation sources, analysers and detectors. For example, an AC or RF ion guide 1*a* may allow ions to pass from an ionisation source through to a mass analyser in one mode of operation and in another mode of operation the ion guide 1*a* may receive ions from the mass analyser or an ion trap and direct them through a third port to a detector. Ions may be allowed to pass through a port or may be prevented from passing through a port by applying a suitable potential to an element adjacent to a particular port. An AC or RF ion guide 1*a* with a plurality of ports may be used to direct ion flow in a plurality of directions.

Figure 17:
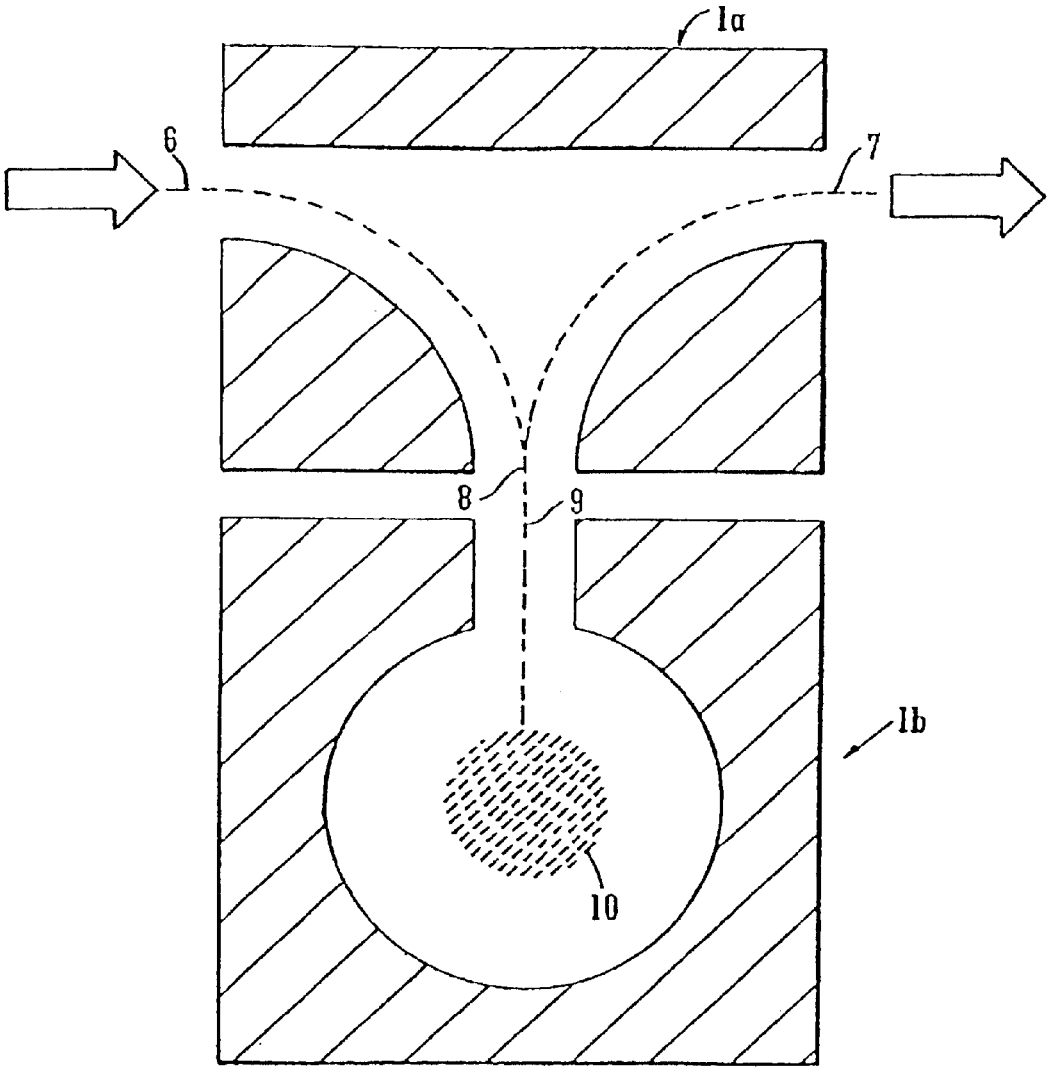
FIG. 17 shows an embodiment of an ion guide having three ports combined with an RF ion guide having one port and an ion trapping region.

FIG. 17 shows another embodiment having a first AC or RF ion guide 1*a* with three ports 6,7,8 and a second AC or RF ion guide 1*b* having a single port 9. Ions enter the first AC or RF ion guide 1*a* through entrance port 6 and are directed through 90° to port 8. The ions then pass into the second AC or RF ion guide 1*b* via port 9. The second AC or RF ion guide 1*b* has a single port 9 and an ion storage area 10 for receiving and storing ions. In a mode of operation ions which have been stored or trapped in the trapping or storage region 10 may then be arranged to exit the second AC or RF ion guide 1*b* via port 9 and re-enter the first AC or RF ion guide 1*a* through port 8 through which the ions had previously exited. The ions are then directed through 90° to the exit port 7 through which the ions exit the first ion guide 1*a*.

The ions may or may not be encouraged to move through a particular port 6,7,8,9 by application of suitable voltages to elements immediately adjacent to the port. For examples ions may be encouraged to enter or leave the second AC or RF ion guide 1*b* by lowering or raising the DC potential applied to the second AC or RF ion guide with respect to the DC potential applied to the first AC or RF ion guide 1*a*.

Figure 18A:
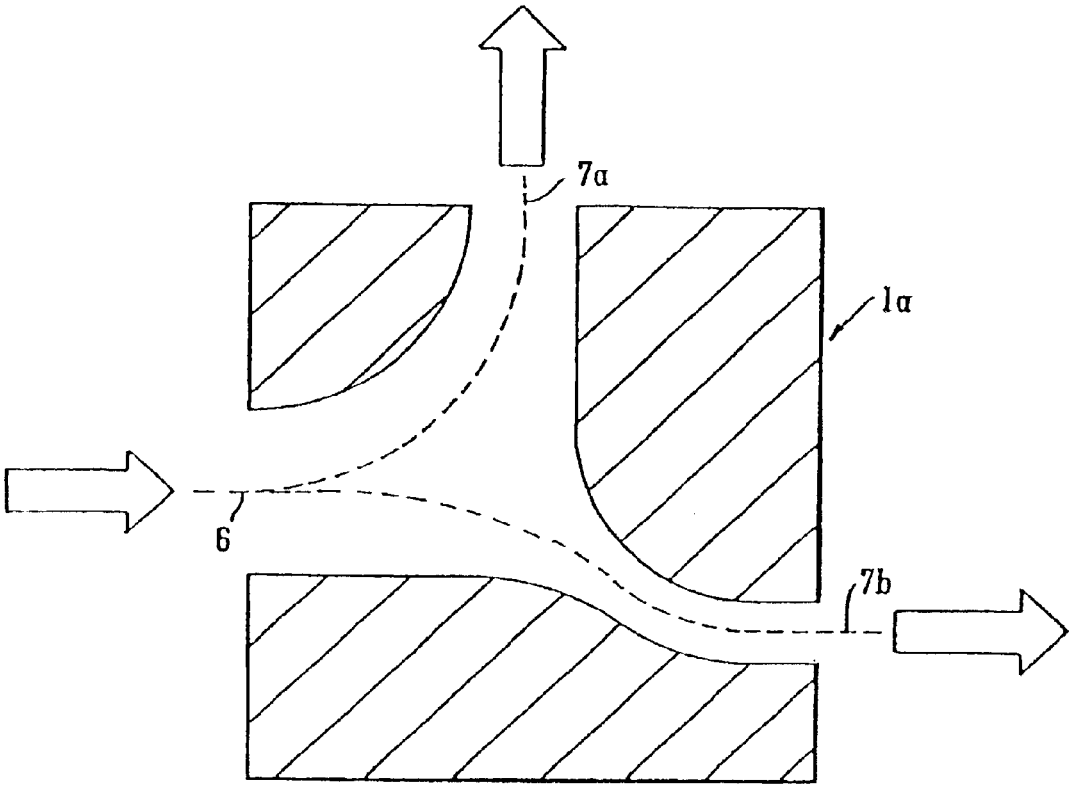
FIG. 18A shows an embodiment of an ion guide having three different sized and shaped ion paths and FIG. 18B shows a cross-section of an ion guide having a non-rectangular cross-sectional profile.

FIG. 18A shows further embodiments wherein an AC or RF ion guide 1*a* is used to change or vary the cross-sectional beam profile of a beam of ions or to change the cross-sectional area of the ion beam. According to an embodiment the entrance port 6 may be preferably matched in terms of both size and cross-sectional shape to that of the incoming ion beam. Similarly, the exit ports 7*a*,7*b* may also be matched in terms of size and cross-sectional profile to match the optimum size and cross-sectional profile of the ion optical devices positioned downstream of the AC or RF ion guide 1*a* and which are to receive the stream of ions exiting from the ion guide 1*a*. The entrance port 6 and the two exit ports 7*a*,7*b* may all have different cross-sectional areas and/or cross-sectional profiles. Preferably, the cross-sectional area of the entrance port(s) substantially equals the sum of the cross-sectional areas of the exit port(s). The guiding regions between the ports 6,7*a*,7*b* may also have lengths which vary in size and/or shape continuously.

Figure 18B:
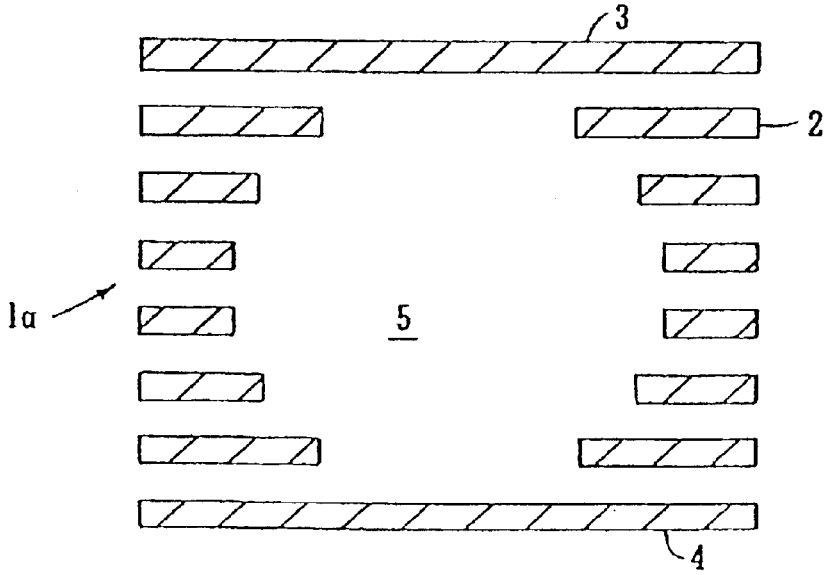

FIG. 18B shows an embodiment of an AC or RF ion guide 1*a* wherein the plate electrodes 2 carrying the AC or RF voltage have a channel having a width that progressively changes from an upper portion of the ion guide 1*a* to the lower portion of the ion guide 1*a*. In the embodiment shown in FIG. 18B the width of the channel in the plate electrodes 2 is such that a beam of ions passing through the ion guide 1*a* will have a substantially circular cross-sectional profile.

Other embodiments are contemplated wherein the shape and size of each port or ion path may be different to that of the others. Such AC or RF ion guides 1*a* may also be constructed with cross-sectional shapes or profiles other than rectangular or circular.

Figure 19A:
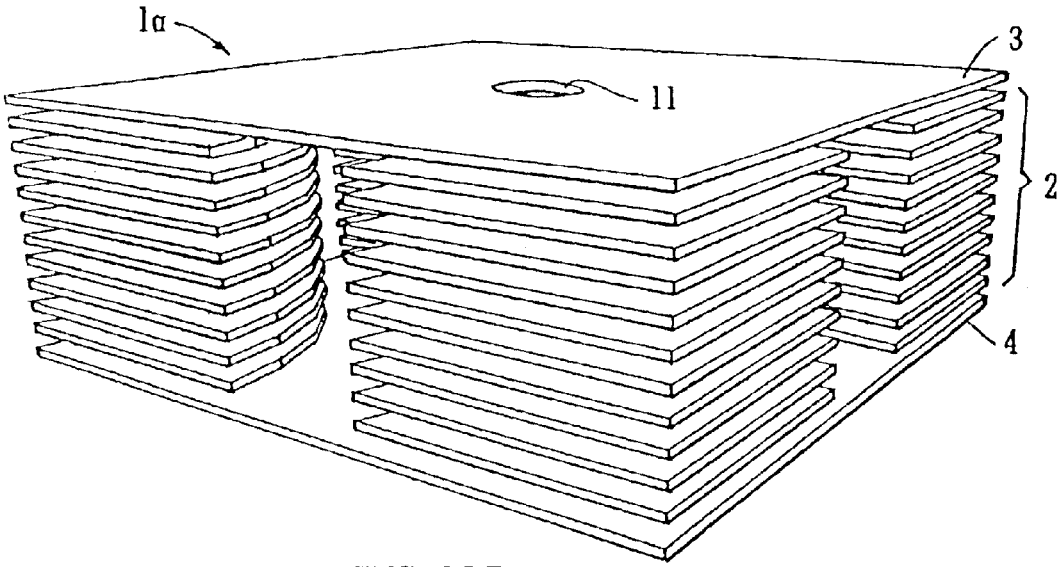
FIG. 19A shows an embodiment wherein an ion guide has a total of six ports and FIG. 19B shows another embodiment wherein an ion guide has a total of six ports.
Figure 19B:
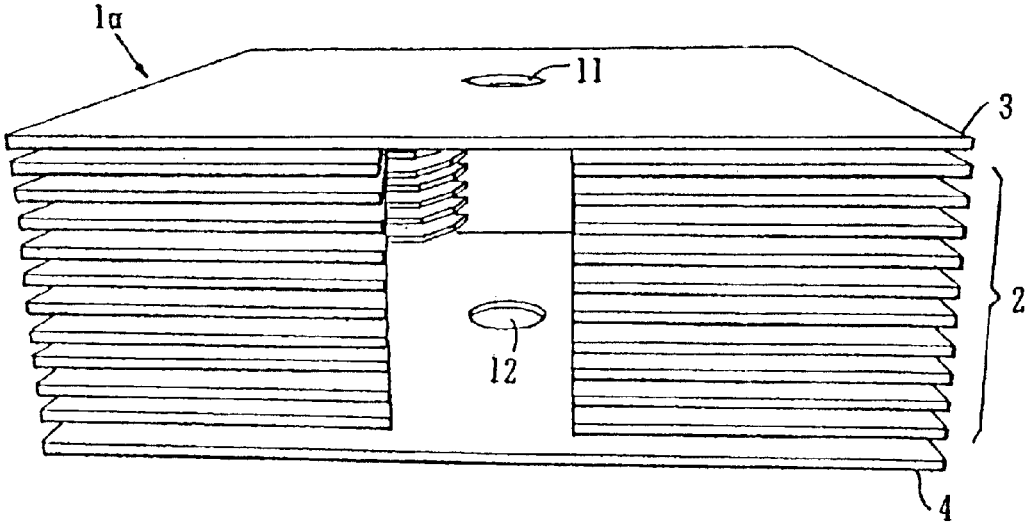

FIGS. 19A and 19B illustrate yet further embodiments wherein ions are arranged to enter and/or exit the AC or RF ion guide 1*a* through the upper plate electrode 3 and/or through the lower plate electrode 4. The embodiment shown in FIGS. 19A and 19B is similar to the embodiments shown in FIGS. 12, 14 and 15 except that an additional port 11 in the upper plate electrode 3 and an additional port 12 in the lower plate electrode 4 are provided. The additional ports 11,12 may be used to allow ions (or gas or a laser beam) to be introduced into the AC or RF ion guide 1*a* or to allow ions (or gas or a laser beam) to exit the AC or PF ion guide 1*a*. In the example shown in FIGS. 19A and 19B the AC or RF ion guide 1*a* has a total of six ports.

Figure 20:
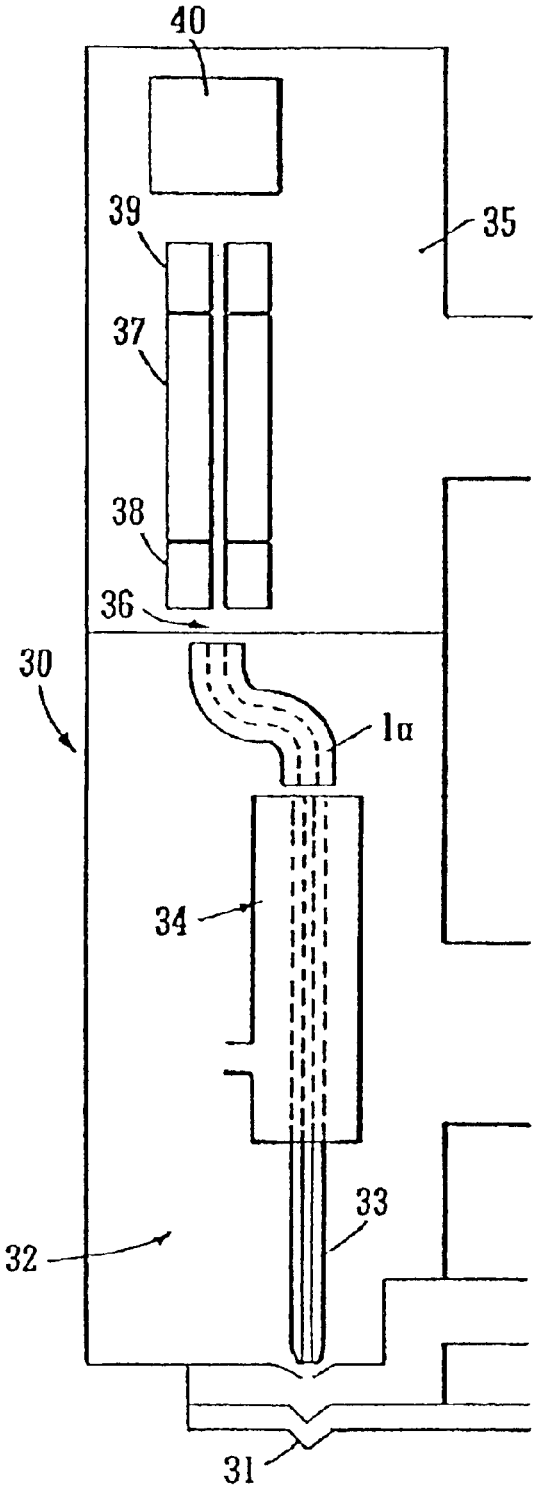
FIG. 20 shows a mass spectrometer incorporating a preferred ion guide.

FIG. 20 shows a plan view of a preferred embodiment wherein an AC or RF ion guide 1*a* is provided downstream of a collision cell 34 in a mass spectrometer 30. Various vacuum ports are shown extending horizontally for ease of illustration whereas according to the preferred embodiment the vacuum ports preferably extend vertically below the mass spectrometer 30. The mass spectrometer 30 preferably comprises an Inductively Coupled Plasma ("ICF") ion source (not shown). A number of sampling cones 31 and vacuum pumps may be provided to allow a portion of the ions emitted from the ion source to pass into a vacuum chamber 32. The ions are then arranged to enter an RF hexapole ion guide 33 which preferably has an enclosed section 34. Gas is preferably introduced into the enclosed section 34 so that ions passing through the enclosed section 34 will collide with the gas introduced into the enclosed section 34. These collisions cause the ions to lose energy. Argon and other ions from the plasma may preferably be substantially attenuated from the beam of ions by charge exchange with the collision gas. The remaining analyte ions then exit the hexapole ion guide 33 and enter a S-shaped AC or RF ion guide 1*a* which displaces ions laterally. These ions then exit the S-shaped AC or RF ion guide 1*a* and pass into the next (analyser) vacuum chamber 35 through an interchamber orifice 36. The ions then pass through a quadrupole mass filter 37, having a pre-filter 38 and post-filter 39, for mass analysis and then onto a detector 40 which is preferably cylindrically shaped and arranged along the horizontal axis.

ICP ion sources tend to yield a high level of fast neutral atoms and molecules and an intense beam of visible and UV radiation. The collision/reaction cell 34 can also give rise to a background of fast neutral atoms and molecules. The visible and UV radiation and the fast particles if allowed to get to the detector will give rise to a continuum of background noise. This noise would interfere with the measurement of analyte signals and limit their detection. The S-shaped RF ion guide 1*a* advantageously eliminates any line-of-sight path thereby preventing fast neutrals and radiation reaching the detector 40 whilst still guiding ions through the mass spectrometer 30 for subsequent mass analysis and detection.

The ion signal for uranium ions (m/z 238) was measured using the embodiment shown in FIG. 20. An ICP torch provided the source of ions to be analysed by an analyser having a low mass resolution of 12.6 and a high mass resolution of 15.6. The ICP torch was set with the x-axis at 2.54, y-axis at −0.69 and z-axis at 1.10. The pressure in the analyser was maintained at $5.1\times10^{-5}$ mbar and a collisional gas of hydrogen and helium was present in collisional cell 34. Cone lens 31 was set at a potential of 50V, an hexapole exit lens was set at a potential of 190V and the hexapole 33 was biased by 0V. The ions had an energy of 2 eV in the quadrupole mass analyser 37 and were detected by a photomultiplier having a gain set at 450. The measurements indicated that the transmission efficiency of ions through the S-shaped AC or RF ion guide 1*a* was between 50% and 100% whilst the transmission of fast neutrals, visible and UV radiation was substantially eliminated.

Figure 21A:
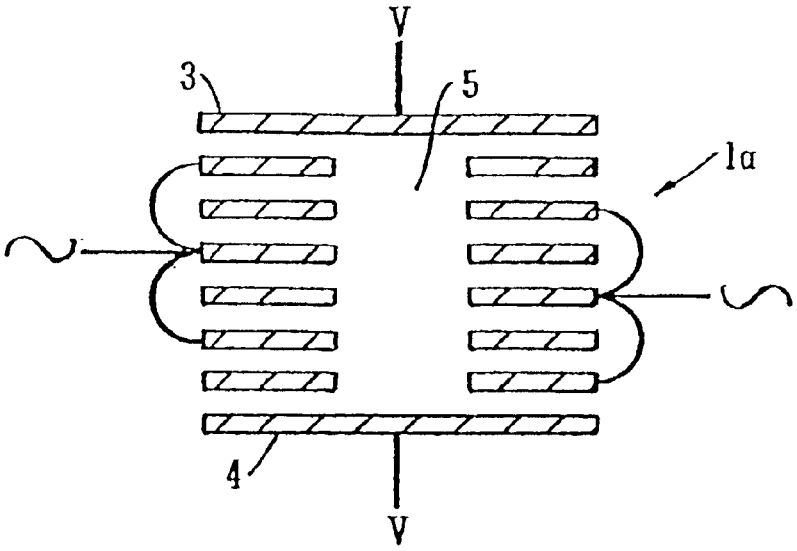
FIG. 21A shows an embodiment of an ion guide operated with a DC voltage applied to the top and bottom plates.
Figure 21B:
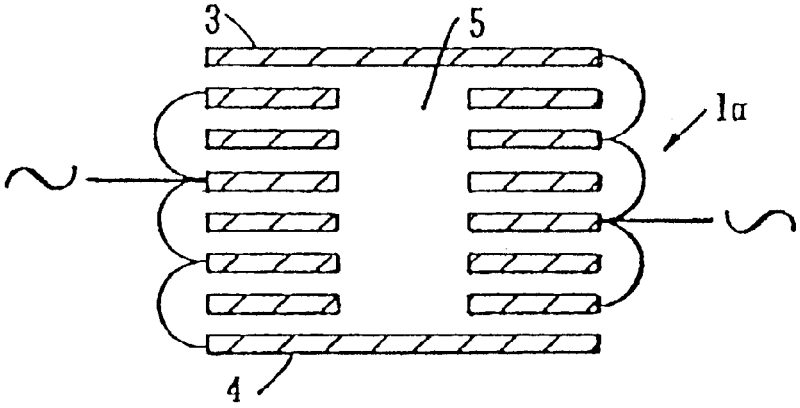
FIG. 21B shows an embodiment of an ion guide operated with an AC or RF voltage applied to the top and bottom plates and FIG. 21C shows an embodiment of an ion guide operated with both a DC and an AC or RF voltage applied to the top and bottom plates.
Figure 21C:
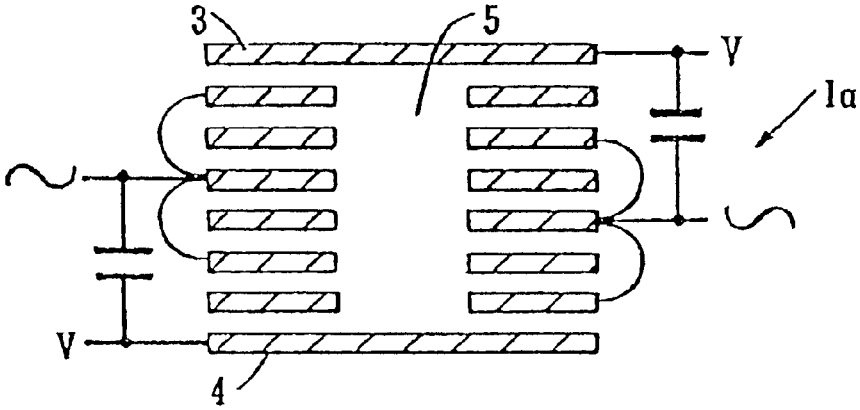

FIGS. 21A–C show three different configurations in which an AC or RF ion guide 1*a* is operated either with a DC bias voltage, an AC or RF voltage or a combination of DC bias voltage and AC or RF voltages applied to the upper plate electrode 3 and the lower plate electrode 4 respectively. When an AC or RF voltage is applied to the upper 3 and lower 4 plate electrodes as shown in FIGS. 21B and 21C then the upper and lower plate electrode 3,4 may either be directly coupled to the next but one plate electrode 2 or may be coupled to another plate electrode 2 via a capacitor so that a 180° phase shift is maintained between adjacent electrodes 2,3,4.

The transmission of atomic ions for beryllium, cobalt, indium and uranium for the three different configurations shown in FIGS. 21A, 21B and 21C respectively and for different DC voltages were tested and the results are presented in the table below.

| | | Sensitivity by mass (cps) | | | |
|---|---|---|---|---|---|
| | V (volts) | Be 9 Da | Co 59 Da | In 115 Da | U 238 Da |
| Configuration 1 | 2 | 5000 | 1100000 | 1600000 | 1500000 |
| (FIG. 21A) | 5 | 500 | 550000 | 1300000 | 1800000 |
| Configuration 2 | 0 | 15000 | 900000 | 1800000 | 1700000 |
| (FIG. 21B) | | | | | |
| Configuration 3 | −5 | 20000 | 0 | 0 | 0 |
| (FIG. 21C) | 0 | 20000 | 1200000 | 2500000 | 1900000 |

-continued

| | Sensitivity by mass (cps) | | | |
|---|---|---|---|---|
| V (volts) | Be 9 Da | Co 59 Da | In 115 Da | U 238 Da |
| 1 | 15000 | 1200000 | 2700000 | 2500000 |
| 10 | 0 | 50000 | 1000000 | 3400000 |

It can be seen from the above table of the relative sensitivity measurements for the four elements that the application of an AC or RF voltage in place of or in addition to a DC bias voltage applied to the plates 3,4 is beneficial. The application of predominantly an AC or RF voltage as in FIG. 21B appears to offer the best overall transmission over a wide mass range. However, the application of a combination of an AC or RF voltage and a DC bias voltage would appear to enhance the transmission over a more limited mass range. The combination of an AC or RF voltage and 10 V DC as in FIG. 21C provided a transmission for uranium approximately twice that previously recorded for the mass spectrometer shown in FIG. 20 when the exit of the RF hexapole ion guide 33 was arranged to be adjacent to the interchamber orifice 36 leading to the quadrupole mass analyser 37.

Figure 22:
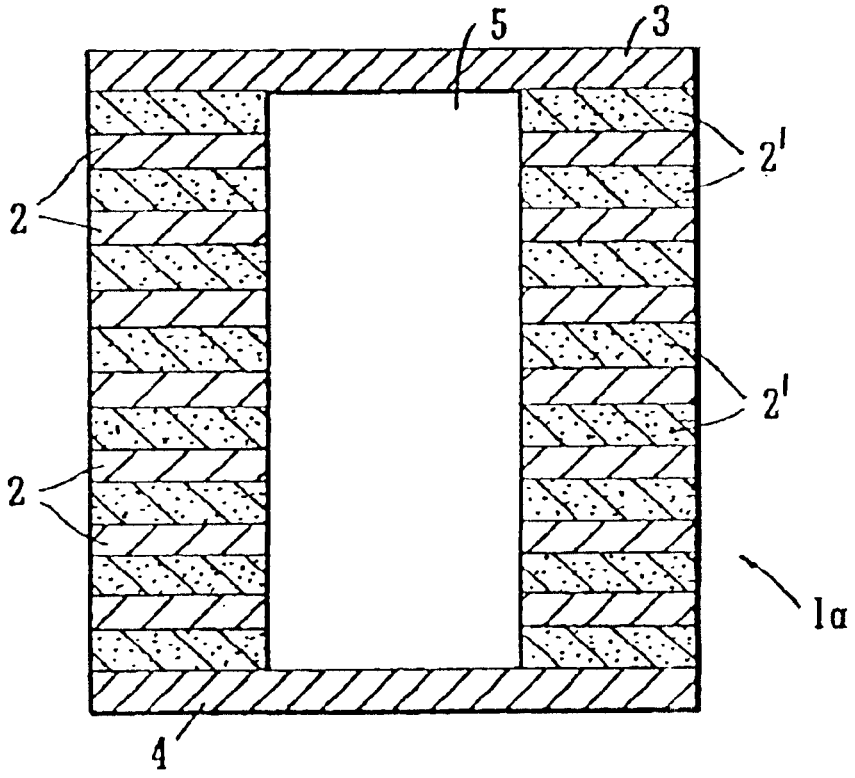
FIG. 22 shows an ion guide comprised of a stack of electrodes mounted on or deposited on insulators.

FIG. 22 shows an embodiment wherein the electrodes 2 are mounted on or provided on top of insulators 2'. According to one embodiment the insulators 2' may comprise Bakelite (RTM), a ceramic or a plastic such as PTFE, polyethylene, PEEK or Kapton (RTM). The electrodes 2 may be interspersed or interleaved between the insulators 2'. According to one embodiment the electrodes 2 may be deposited on to the insulators 2' and may comprise, for example, electrically conductive paint. According to this embodiment the electrode layers preferably have a thickness of approximately 250 $\mu$m. A particularly advantageous feature of the embodiment shown in FIG. 22 is that there are preferably no air gaps between the electrodes 2 and the insulators 2'. Accordingly, gas within the ion guide 1*a* is preferably prevented from exiting the ion guide 1*a* apart from at the entrance and exit to the ion guide. The ion guide 1*a* shown in FIG. 22 is therefore particularly suitable for use as a collision or reaction cell wherein gas is introduced into the ion guide 1*a*. A gas inlet port may be provided in an upper 3 or lower 4 plate electrode but preferably gas does not exit the ion guide 1*a* via this port. Since the ion guide 1*a* shown in FIG. 22 will be substantially less leaky than embodiments wherein there is an air gap between electrodes, then the gas introduced into the ion guide 1*a* can be maintained at a relatively high pressure without requiring larger vacuum pumps to be used. Similarly, a greater pressure differential can be maintained along the length of the ion guide 1*a* compared to other embodiments.

Although the present invention has been described with reference to preferred embodiments, it will be understood by those skilled in the art that various changes in form and detail may be made without departing from the scope of the invention as set forth in the accompanying claims.

What is claimed is:

1. A mass spectrometer comprising an ion guide, said ion guide comprising a plurality of plate electrodes arranged in a plane in which ions travel in use, said ion guide having an entrance for receiving ions along a first axis and an exit from which ions emerge from said ion guide along a second axis, wherein said second axis is at an angle θ to said first axis and wherein θ>0°.

2. A mass spectrometer as claimed in claim 1, wherein θ falls within one of the group of ranges consisting of: (i) >10°; (ii) 10–20°; (iii) 20–30°; (iv) 30–40°; (v) 40–50°; (vi) 50–60°; (vii) 60–70°; (viii) 70–80°; (ix) 80–90°; 90–100°; (xi) 100–110°; (xii) 110–120°; (xiii) 120–130°; (xiv) 130–140°; (xv) 140–150°; (xvi) 150–160°; (xvii) 160–170°; and (xviii) 170–180°.

3. A mass spectrometer comprising an ion guide, said ion guide comprising a plurality of plate electrodes arranged in a plane in which ions travel in use, said ion guide having an entrance for receiving ions along a first axis and an exit from which ions emerge from said ion guide along a second axis, wherein said ion guide further comprises a curved ion guiding region between said entrance and said exit.

4. A mass spectrometer as claimed in claim 3, wherein said ion guiding region is substantially "S"-shaped and/or has a single point of inflexion.

5. A mass spectrometer as claimed in claim 3, wherein said first axis is substantially parallel to said second axis.

6. A mass spectrometer as claimed in claim 3, wherein said second axis is laterally displaced from said first axis.

7. A mass spectrometer comprising an ion guide, said ion guide comprising a plurality of plate electrodes, said ion guide having an entrance for receiving ions along a first axis, a curved ion guiding region and an exit from which ions emerge from said ion guide along a second axis, wherein said second axis is substantially co-axial with said first axis.

8. A mass spectrometer as claimed in claim 7, further comprising a device arranged at least partially outside of said ion guiding region to block particles and/or photons passing directly from said entrance to said exit.

9. A mass spectrometer as claimed in claim 8, wherein said device comprises a baffle, plate or electrode.

10. A mass spectrometer comprising:

a first ion guide comprising a plurality of plate electrodes arranged in a plane in which ions travel in use, said first ion guide having an entrance for receiving ions and an exit from which ions emerge from said first ion guide; and a second ion guide comprising a plurality of plate electrodes, said second ion guide having an entrance for receiving ions and an exit from which ions emerge from said second ion guide.

11. A mass spectrometer as claimed in claim 10, further comprising a third ion guide comprising a plurality of plate electrodes, said third ion guide having an entrance for receiving ions and an exit from which ions emerge from said third ion guide.

12. A mass spectrometer as claimed in claim 11, further comprising a fourth ion guide comprising a plurality of plate electrodes, said fourth ion guide having an entrance for receiving ions and an exit from which ions emerge from said fourth ion guide.

13. A mass spectrometer as claimed in claim 10, wherein in a mode of operation said first ion guide and said second ion guide are maintained in use at different DC potentials so that ions exiting said first ion guide are urged into said second ion guide.

14. A mass spectrometer as claimed in claim 11, wherein in a mode of operation said second ion guide and said third ion guide are maintained in use at different DC potentials so that ions exiting said second ion guide are urged into said third ion guide.

15. A mass spectrometer as claimed in claim 12, wherein in a mode of operation said third ion guide and said fourth ion guide are maintained in use at different DC potentials so that ions exiting said third ion guide are urged into said fourth ion guide.

16. A mass spectrometer as claimed in claim 10, wherein in a mode of operation said second ion guide is maintained at a different DC potential to said first ion guide so that ions are trapped in said first ion guide.

17. A mass spectrometer as claimed claim 11, wherein in a mode of operation said third ion guide is maintained at a different DC potential to said second ion guide so that ions are trapped in said second ion guide.

18. A mass spectrometer as claimed in claim 12, wherein in a mode of operation said fourth ion guide is maintained at a different DC potential to said third ion guide so that ions are trapped in said third ion guide.

19. A mass spectrometer as claimed in claim 12, wherein either said first and/or second and/or third and/or fourth ion guide comprise a ion storage region.

20. A mass spectrometer as claimed in claim 19, wherein in a first mode of operation said ion storage region receives ions through a single port and in a second mode of operation ions emerge from said ion storage area through said single port.

21. A mass spectrometer comprising an ion guide, said ion guide comprising a plurality of plate electrodes arranged in a plane in which ions travel in use, said ion guide having two or more entrances for receiving ions and one or more exits from which ions emerge from said ion guide.

22. A mass spectrometer as claimed in claim 21, wherein said ion guide comprises two entrances for receiving ions and one exit from which ions emerge from said ion guide.

23. A mass spectrometer as claimed in claim 21, wherein said ion guide comprises three entrances for receiving ions and one exit from which ions emerge from said ion guide.

24. A mass spectrometer as claimed in claim 21, further comprising at least two ion sources, wherein ions from a first ion source enter a first entrance and ions from a second ion source enter a second entrance and wherein said first and/or said second ion source are selected from the group consisting of: (i) an Electrospray ("ESI") ion source; (ii) an Atmospheric Pressure Chemical Ionisation ("APCI") ion source; (iii) an Atmospheric Pressure Photo Ionisation ("APPI") ion source; (iv) a Matrix Assisted Laser Desorption Ionisation ("MALDI") ion source; (v) a Laser Desorption Ionisation ("LDI") ion source; (vi) an Inductively Coupled Plasma ("ICP") ion source; (vii) an Electron Impact ("EI") ion source; (viii) a Chemical Ionisation ("CI") ion source; (ix) a Fast Atom Bombardment ("FAB") ion source; and (x) a Liquid Secondary Ions Mass Spectrometry ("LSIMS") ion source.

25. A mass spectrometer comprising an ion guide, said ion guide comprising a plurality of plate electrodes arranged in a plane in which ions travel in use, said ion guide having one or more entrances for receiving ions and two or more exits from which ions emerge from said ion guide.

26. A mass spectrometer as claimed in claim 25, wherein said ion guide comprises one entrance for receiving ions and two exits from which ions emerge from said ion guide.

27. A mass spectrometer as claimed in claim 25, wherein said ion guide comprises one entrance for receiving ions and three exits from which ions emerge from said ion guide.

28. A mass spectrometer as claimed in claim 25, wherein said ion guide comprises at least two entrances for receiving ions and at least two exits front which ions emerge from said ion guide.

29. A mass spectrometer as claimed in claim 28, further comprising at least two ion sources, wherein ions from a first ion source enter a first entrance and ions from a second ion source enter a second entrance and wherein said first and/or said second ion source are selected from the group consisting of: (i) an Electrospray ("ESI") ion source; (ii) an Atmospheric Pressure Chemical Ionisation ("APCI") ion source; (iii) an Atmospheric Pressure Photo Ionisation ("APPI") ion source; (iv) a Matrix Assisted Laser Desorption Ionisation ("MALDI") ion source; (v) a Laser Desorption Ionisation ("LDI") ion source; (vi) an Inductively Coupled Plasma ("ICP") ion source; (vii) an Electron Impact ("EI") ion source; (viii) a Chemical Ionisation ("CI") ion source; (ix) a Fast Atom Bombardment ("FAB") ion source; and (x) a Liquid Secondary Ions Mass Spectrometry ("LSIMS") ion source.

30. A mass spectrometer as claimed in claim 25, wherein in use a beam of ions entering an entrance of said ion guide is divided into two or more beams, a first beam exiting said ion guide via a first exit and a second beam exiting said ion guide via a second exit.

31. A mass spectrometer as claimed in claim 30, wherein in use the ions entering an entrance of said ion guide are divided into two or more beams by one or more electrodes arranged adjacent to said entrance, one or more electrodes disposed within said ion guide or one or more electrodes arranged adjacent to an exit of said ion guide.

32. A mass spectrometer as claimed in claim 30, wherein said first beam comprises a percentage of the ions in said beam of ions entering said ion guide selected from the group consisting of: (i) 0–10%; (ii) 10–20%; (iii) 20–30%; (iv) 30–40%; (v) 40–50%; (vi) 50–60%; (vii) 60–70%; (viii) 70–80%; (ix) 80–90%; and (x) greater than 90%.

33. A mass spectrometer as claimed in claim 25, wherein at least part of a beam of ions entering said ion guide is switchable to or between one of a plurality of exits.

34. A mass spectrometer as claimed in claim 33, wherein in use the ions entering an entrance of said ion guide are switchable to or between one of a plurality of exits by one or more electrodes arranged adjacent to said entrance, one or more electrodes disposed within said ion guide or one or more electrodes arranged adjacent to an exit of said ion guide.

35. A mass spectrometer as claimed in claim 25, further comprising a first ion detector disposed to receive ions exiting from a first exit and a second ion detector disposed to receive ions exiting from a second ion exit.

36. A mass spectrometer as claimed in claim 25, further composing a first mass analyser disposed to receive ions exiting from a first exit and a second mass analyser disposed to receive ions exiting from a second ion exit.

37. A mass spectrometer as claimed in claim 25, further comprising a mass analyser disposed to receive ions exiting said ion guide from a first exit and an ion detector disposed to receive ions exiting said ion guide from a second exit.

38. A mass spectrometer as claimed in claim 25, said mass spectrometer further comprising:

an ion storage device disposed to receive ions exiting said ion guide from a first exit, said ion storage device comprising a plurality of plate electrodes, wherein in a first mode of operation a beam of ions enters said ion storage device via a port and wherein in a second mode of operation a beam of ions exits from said ion storage device via said port; and a mass analyser disposed to receive ions exiting said ion guide from a second exit.

39. A mass spectrometer comprising an ion guide, said ion guide comprising a plurality of plate electrodes arranged in a plane in which ions travel in use, said ion guide having one or more entrances for receiving ions and one or more exits from which ions emerge from said ion guide, wherein in a first mode of operation a beam of ions enters said ion guide via a first port and exits said ion guide via a second port and wherein in a second mode of operation a beam of ions enters said ion guide via said second port.

40. A mass spectrometer as claimed in claim 39, wherein in said second mode of operation said beam of ions exits said ion guide via said first port.

41. A mass spectrometer as claimed in claim 39, wherein in said second mode of operation said beam of ions exits said ion guide via a third port different from said first and said second ports.

42. A mass spectrometer comprising an ion storage device, said ion storage device comprising a plurality of plate electrodes arranged in a plane in which ions travel in use, wherein in a first mode of operation a beam of ions enters said in storage device via a port and wherein in a second mode of operation a beam of ions exits from said ion storage device via said same port.

43. A mass spectrometer comprising an ion guide, said ion guide comprising a plurality of plate electrodes arranged in a plane in which ions travel in use, said ion guide having an entrance for receiving ions and an exit from which ions emerge from said ion guide, said entrance having a first cross-sectional profile and a first cross-sectional area, said exit having a second cross-sectional profile and a second cross-sectional area, wherein said first cross-sectional profile is different to said second cross-sectional profile and/or said first cross-sectional area is different to said second cross-sectional area.

44. A mass spectrometer as claimed in claim 43, wherein said first cross-sectional profile and/or said second cross-sectional profile have a substantially circular or oval cross-section.

45. A mass spectrometer as claimed in claim 43, wherein said first cross-sectional profile and/or said second cross-sectional profile have a substantially rectangular or square cross-section.

46. A mass spectrometer as claimed in claim 43, wherein in use an ion beam is received by said ion guide, said ion beam having a third cross-sectional profile and a third cross-sectional area, wherein said first cross-sectional profile and/or said first cross-sectional area is substantially the same or similar to said third cross-sectional profile and/or said third cross-sectional area.

47. A mass spectrometer as claimed in claim 43, further comprising an ion-optical device downstream of said ion guide wherein the entrance to said ion-optical device has a fourth cross-sectional profile and a fourth cross-sectional area, wherein said second cross-sectional profile and/or said second cross-sectional area is substantially the same or equal to said fourth cross-sectional profile and/or said fourth cross-sectional area.

48. A mass spectrometer as claimed claim 47, wherein said ion-optical device comprises a device selected from the group consisting of: (i) an ion guide having a substantially circular cross-sectional profile; (ii) a quadrupole mass filter/analyser having a substantially circular cross-sectional profile; (iii) an orthogonal acceleration Time of Flight mass analyser having a substantially square or rectangular cross-sectional profile; (iv) a magnetic sector analyser having a substantially rectangular cross-sectional profile; (v) a Fourier Transform Ion Cyclotron Resonance ("FTICR") mass analyser having a substantially circular cross-sectional profile; (vi) a 2D (linear) quadrupole ion trap having a substantially circular cross-sectional profile; and (vii) a 3D (Paul) quadrupole ion trap having a substantially circular cross-sectional profile.

49. A mass spectrometer as claimed in claim 43, wherein an ion guiding region between said entrance and said exit either: (i) varies in size and/or shape along the length of the ion guiding region; or (ii) has a width and/or height which progressively tapers in size.

50. A mass spectrometer as claimed in claim 43, wherein said ion guide further comprises a second entrance for receiving ions and/or a second exit from which ions emerge from said ion guide, said second entrance having a fifth cross-sectional profile and a fifth cross-sectional area, said second exit having a sixth cross-sectional profile and a sixth cross-sectional area, wherein said fifth cross-sectional profile is different to said sixth cross-sectional profile and/or said fifth cross-sectional area is different to said sixth cross-sectional area.

51. A mass spectrometer as claimed in claim 50, wherein said first cross-sectional profile and said first cross-sectional area and/or said second cross-sectional profile and said second cross-sectional area and/or said fifth cross-sectional profile and said fifth cross-sectional area and/or said sixth cross-sectional profile and said sixth cross-sectional area are different.

52. A mass spectrometer as claimed in claim 43, wherein at least 50% of said plates are substantially parallel.

53. A mass spectrometer as claimed in claim 43, wherein at least 50% of said plates are arranged in a first plane and said ion guide is curved in said first plane.

54. A mass spectrometer as claimed in claim 43, wherein at least 50% of said plates are arranged at an entrance of said ion guide in a first plane and said ion guide is curved in a second plane orthogonal to said first plane.

55. A mass spectrometer as claimed in claim 43, wherein at least 50% of said plates are substantially equidistant.

56. A mass spectrometer as claimed in claim 43, wherein said plurality of plate electrodes comprises 2 or more plate electrodes.

57. A mass spectrometer as claimed in claim 43, wherein said plate electrodes have a thickness less than or equal to 5 mm.

58. A mass spectrometer as claimed in claim 43, wherein said plate electrodes are spaced apart from one another by a distance less than or equal to 5 mm.

59. A mass spectrometer as claimed in claim 43, wherein said plate electrodes are supplied with an AC or RF voltage.

60. A mass spectrometer as claimed in claim 59, wherein adjacent plate electrodes are supplied with opposite phases of said AC or RF voltage.

61. A mass spectrometer as claimed in claim 59, wherein said AC or RF voltage has a frequency selected from the group consisting of: (i) <100 kHz; (ii) 100–200 kHz; (iii) 200–300 kHz; (iv) 300–400 kHz; (v) 400–500 kHz; (vi) 0.5–1.0 MHz; (vii) 1.0–1.5 MHz; (viii) 1.5–2.0 MHz; (ix) 2.0–2.5 MHz; (x) 2.5–3.0 MHz; (xi) 3.0–3.5 MHz; (xii) 3.5–4.0 MHz; (xiii) 4.0–4.5 MHz; (xiv) 4.5–5.0 MHz; (xv) 5.0–5.5 MHz; (xvi) 5.5–6.0 MHz; (xvii) 6.0–6.5 MHz; (xviii) 6.5–7.0 MHz; (xix) 7.0–7.5 MHz; (xx) 7.5–8.0 MHz; (xxi) 8.0–8.5 MHz; (xxii) 8.5–9.0 MHz; (xxiii) 9.0–9.5 MHz; (xxiv) 9.5–10.0 MHz; and (xxv) >10.0 MHz.

62. A mass spectrometer as claimed in claim 59, wherein the amplitude of said AC or RF voltage is selected from the group consisting of: (i) <50V peak to peak; (ii) 50–100V peak to peak; (iii) 100–150V peak to peak; (iv) 150–200V peak to peak; (v) 200–250V peak to peak; (vi) 250–300V peak to peak; (vii) 300–350V peak to peak; (viii) 350–400V peak to peak; (ix) 40014 450V peak to peak; (x) 450–500V peak to peak; and (xi) >500V peak to peak.

63. A mass spectrometer as claimed in claim 43, wherein said ion guide is maintained, in use, at a pressure greater than or equal to 0.0001 mbar.

64. A mass spectrometer as claimed in claim 43, wherein said ion guide is maintained, in use, at a pressure less than or equal to 10 mbar.

65. A mass spectrometer as claimed in claim 43, wherein said ion guide is maintained between 0.0001 and 10 mbar.

66. A mass spectrometer as claimed in claim 43, wherein said ion guide is maintained, in use, at a pressure greater than or equal to $1\times10^{-7}$ mbar.

67. A mass spectrometer as claimed in claim 43, wherein said ion guide is maintained, in use, at a pressure less than or equal to $1\times10^{-4}$ mbar.

68. A mass spectrometer as claimed in claim 43, wherein said ion guide is maintained, in use, at a pressure between $1\times10^{-7}$ and $1\times10^{-4}$ mbar.

69. A mass spectrometer as claimed in claim 43, wherein said ion guide further comprises a first outer plate electrode arranged on a first side of said ion guide and a second outer plate electrode arranged on a second side of said ion guide.

70. A mass spectrometer as claimed in claim 69, wherein said first outer plate electrode and/or said second outer plate electrode are arranged to be biased at a bias DC voltage with respect to the mean voltage of the plate electrodes to which an AC or RF voltage is applied.

71. A mass spectrometer as claimed in claim 70, where said bias voltage is selected from the group consisting of: (i) less than −10V; (ii) −9 to −8V; (iii) −8 to −7V; (iv) −7 to −6V; (v) −6 to −5V; (vi) −5 to −4V; (vii) −4 to −3V; (viii) −3 to −2V; (ix) −2 to −1V; (x) −1 to 0V; (xi) 0 to 1V; (xii) 1 to 2V; (xiii) 2 to 3V; (xiv) 3 to 4V; (xv) 4 to 5V; (xvi) 5 to 6V; (xvii) 6 to 7V; (xviii) 7 to 8V; (xix) 8 to 9V; (xx) 9 to 10V; and (xxi) more than 10V.

72. A mass spectrometer as claimed in claim 70, wherein said first outer plate electrode and/or said second outer plate electrode are supplied in use with a DC only voltage.

73. A mass spectrometer as claimed in claim 70, wherein said first outer plate electrode and/or said second outer plate electrode are supplied in use with an AC or RF only voltage.

74. A mass spectrometer as claimed in claim 70, wherein said first outer plate electrode and/or said second outer plate electrode are supplied in use with a DC and an AC or RF voltage.

75. A mass spectrometer as claimed in claim 69, further comprising an ion and/or gas and/or laser beam port arranged in said first outer plate electrode.

76. A mass spectrometer as claimed in claim 69, further comprising an ion and/or gas and/or laser port arranged in said second outer plate electrode.

77. A mass spectrometer as claimed in claim 43, wherein one or more of said plate electrodes is maintained in use at a different DC potential to the other plate electrodes so that a plurality of discrete ion guiding regions are formed within said ion guide.

78. A mass spectrometer as claimed in claim 43, wherein a plurality of said plate electrodes are maintained at different DC potentials.

79. A mass spectrometer as claimed in claim 78, wherein said ion guide comprises a first outer portion, a second outer portion and an intermediate portion between said first and second outer portions and wherein the DC potential at which said plate electrodes are maintained is increased in said first and/or second outer portions relative to said intermediate portion so that ions are directed back towards a central region of said ion guide.

80. A mass spectrometer as claimed in claim 43, wherein one or more transient DC potentials or one or more DC potential waveforms are applied to said plate electrodes.

81. A mass spectrometer as claimed in claim 80, wherein said one or more transient DC potentials or said one or more DC potential waveforms urge ions from one region of said ion guide to another region of said ion guide.

82. A mass spectrometer comprising an ion guide, said ion guide comprising:

a plurality of electrode layers arranged in a plane in which ions travel in use; and a plurality of insulator layers interspersed or interleaved between said electrode layers.

83. A mass spectrometer as claimed in claim 82, wherein at least 10% of said electrode layers are arranged on or are deposited on said insulator layers.

84. A mass spectrometer comprising an AC or RF ion guide, said ion guide comprising:

a plurality of electrodes arranged in a plane in which ions travel in use;

a plurality of insulators interspersed or interleaved between said electrodes;

wherein said electrodes are mounted on or deposited on said insulators.

85. A mass spectrometer as claimed in claim 84, wherein said ion guide has an ion entrance and an ion exit and wherein gas molecules within said ion guide are substantially prevented from exiting said ion guide other than through said ion entrance or said ion exit.

86. A mass spectrometer comprising:

a first ion guide;

a gas collision/reaction cell;

a second ion guide downstream of said gas collision/reaction cell, said second ion guide comprising a plurality of plate electrodes arranged in a plane in which the ions travel in use, said second ion guide having an entrance for receiving ions, an ion guiding region through said second ion guide and an exit from which ions emerge from said second ion guide, wherein there is no direct line of sight from said entrance to said exit.

87. A mass spectrometer as claimed in claim 86, further comprising an ion source selected from the group consisting of: (i) an Electrospray ("ESI") ion source; (ii) an Atmospheric Pressure Chemical Ionisation ("APCI") ion source; (iii) an Atmospheric Pressure Photo Ionisation ("APPI") ion source; (iv) a Matrix Assisted Laser Desorption Ionisation ("MALDI") ion source; (v) a Laser Desorption Ionisation ("LDI") ion source; (vi) an Inductively Coupled Plasma ("ICP") ion source; (vii) an Electron Impact ("EI") ion source; (viii) a Chemical Ionisation ("CI") ion source; (ix) a Fast Atom Bombardment ("FAB") ion source; and (x) a Liquid Secondary Ions Mass Spectrometry ("LSIMS") ion source.

88. A mass spectrometer as claimed in claim 86, further comprising a mass analyser arranged downstream of said second ion guide, said mass analyser selected from the group consisting of: (i) a Time of Flight mass analyser; (ii) a quadrupole mass analyser; (iii) a Fourier Transform Ion Cyclotron Resonance ("FTICR") mass analyser; (iv) a 2D (linear) quadrupole ion trap; (v) a 3D (Paul) quadrupole ion trap; and (vi) a magnetic sector mass analyser.

89. A method of mass spectrometry comprising:

generating ions from an atmospheric pressure ion source; and guiding said ions through an ion guide, said ion guide comprising a plurality of plate electrodes arranged in a plane in which ions travel in use and having an entrance for receiving ions and an exit from which ions emerge from the ion guide wherein an ion guiding channel is provided in said plate electrodes and runs substantially the length of said ion guide and wherein the plate electrodes are arranged in the plane of ion travel.

90. A method of manufacturing an ion guide for a mass spectrometer, comprising:

interspersing or interleaving a plurality of electrodes with a plurality of insulators to form an ion guide having a plurality of electrodes arranged on said insulators and in a plane in which ions travel in use to form an ion guide stack.

91. A method of manufacturing an ion guide for a mass spectrometer, comprising:

depositing a plurality of electrode layers on a plurality of insulator layers to form an ion guide stack having a plurality of electrode layers arranged on top of said insulator layers and in a plane in which ions travel in use.

* * * * *